US011148433B2

(12) United States Patent
Otsuka et al.

(10) Patent No.: US 11,148,433 B2
(45) Date of Patent: Oct. 19, 2021

(54) LIQUID EJECTING APPARATUS

(71) Applicant: SEIKO EPSON CORPORATION, Tokyo (JP)

(72) Inventors: Nobutoshi Otsuka, Azumino (JP); Hitotoshi Kimura, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/787,807

(22) Filed: Feb. 11, 2020

(65) Prior Publication Data

US 2020/0254778 A1 Aug. 13, 2020

(30) Foreign Application Priority Data

Feb. 13, 2019 (JP) ..... JP2019-023280
Feb. 13, 2019 (JP) ..... JP2019-023281

(51) Int. Cl.
*B41J 2/175* (2006.01)
*B41J 2/19* (2006.01)
*B41J 2/03* (2006.01)
*B41J 2/18* (2006.01)

(52) U.S. Cl.
CPC ..... *B41J 2/17596* (2013.01); *B41J 2/03* (2013.01); *B41J 2/18* (2013.01); *B41J 2/19* (2013.01); *B41J 2002/031* (2013.01); *B41J 2202/12* (2013.01)

(58) Field of Classification Search
CPC ..... B41J 2/17596; B41J 2/18
See application file for complete search history.

(56) References Cited

U.S. PATENT DOCUMENTS 10,518,551 B1 * 12/2019 McConville ..... B41J 2/17566
2008/0136860 A1 6/2008 Kyoso
2011/0050793 A1 3/2011 Kumagai et al.
2011/0199424 A1 8/2011 Yokouchi et al.
2011/0242156 A1 * 10/2011 Shimoda ..... B41J 2/175 347/6
2012/0062627 A1 3/2012 Nitta et al.
2012/0224007 A1 9/2012 Koike et al.
(Continued)

FOREIGN PATENT DOCUMENTS

CN 1623785 A * 6/2005 ..... B41J 2/17596
EP 2468512 A1 * 6/2012 ..... B41J 2/18
(Continued)

*Primary Examiner* — Julian D Huffman
(74) *Attorney, Agent, or Firm* — Workman Nydegger

(57) ABSTRACT

A liquid ejecting apparatus includes a liquid supply path through which liquid is supplied to a liquid ejecting head, a liquid discharge path through which the liquid is discharged from the liquid ejecting head, a supply-side pressure adjustment mechanism that adjusts a pressure in a supply-side liquid chamber provided in the liquid supply path to a first pressure at which a gas-liquid interface formed at a nozzle of the liquid ejecting head is maintained, a discharge-side pressure adjustment valve that introduces fluid into a discharge-side liquid chamber when a pressure in the discharge-side liquid chamber provided in the liquid discharge path becomes a second pressure which is lower than the first pressure and at which the gas-liquid interface formed at the nozzle is maintained, and a flow mechanism that discharges the liquid in the liquid ejecting head toward the liquid discharge path via the discharge-side liquid chamber.

8 Claims, 10 Drawing Sheets

(56) References Cited

U.S. PATENT DOCUMENTS

| | | | | |
|---|---|---|---|---|
| 2015/0224786 | A1 | 8/2015 | Otsuka et al. | |
| 2016/0001568 | A1 | 1/2016 | Kamei et al. | |
| 2017/0197432 | A1 | 7/2017 | Yamada et al. | |
| 2018/0056664 | A1 | 3/2018 | Koike et al. | |
| 2019/0299619 | A1* | 10/2019 | Katayama | B41J 2/175 |

FOREIGN PATENT DOCUMENTS

| | | | | | |
|---|---|---|---|---|---|
| GB | 2540111 | A * | 1/2017 | | B41J 2/18 |
| JP | 2008-142910 | | 6/2008 | | |
| JP | 2012-183695 | | 9/2012 | | |
| JP | 2013-107403 | | 6/2013 | | |
| JP | 2014-054857 | | 3/2014 | | |
| JP | 2015-116826 | | 6/2015 | | |
| JP | 2015-180554 | | 10/2015 | | |
| JP | 2016-141063 | | 8/2016 | | |
| JP | 2017-124620 | | 7/2017 | | |
| JP | 2018-034378 | | 3/2018 | | |
| JP | 2018075795 | A * | 5/2018 | | |
| JP | 2018-108741 | | 7/2018 | | |
| KR | 20170083502 | A * | 7/2017 | | B41J 2/1404 |
| WO | WO-2018043090 | A1 * | 3/2018 | | B41J 2/18 |

* cited by examiner

LIQUID EJECTING APPARATUS

The present application is based on, and claims priority from JP Application Serial Number 2019-023280, filed Feb. 13, 2019, and JP Application Serial Number 2019-023281, filed Feb. 13, 2019, the disclosures of which are hereby incorporated by reference herein in their entirety.

BACKGROUND

1. Technical Field

The present disclosure relates to a liquid ejecting apparatus such as a printer.

2. Related Art

As an example of a liquid ejecting apparatus, there is an ink jet printer which performs printing by discharging ink as an example of liquid, from a nozzle open in a liquid ejecting head. In such a printer, in order to prevent ink from leaking from the nozzle and air from being drawn through the nozzle when circulating the ink, it is desirable to maintain the pressure near the nozzle of the liquid ejecting head at an appropriate value.

For example, a printer of JP-A-2013-107403 includes calculation unit which obtains a pressure of a nozzle by a calculation expression set in advance, based on the pressures detected from ink tanks that are coupled to a liquid ejecting head and respectively provided upstream and downstream of an ink circulation system. The printer of JP-A-2013-107403 compares a value Y obtained by the calculation unit with a reference value in pressure determination unit and determines whether the pressure is positive or negative with respect to the reference value. In the printer of JP-A-2013-107403, a pump is coupled to the ink circulation system, and when the pressure is determined to be positive with respect to the reference value, the negative pressure value for the nozzle is increased. In this manner, the printer of JP-A-2013-107403 can appropriately maintain the pressure near the nozzle of the liquid ejecting head when circulating the ink.

However, such a printer has a problem in that when a circulation operation for circulating ink is performed, a pressure control for appropriately maintaining the pressure near the nozzle of the liquid ejecting head becomes complicated.

SUMMARY

A liquid ejecting apparatus includes: a liquid ejecting head that has a nozzle surface in which a nozzle that ejects liquid is open; a liquid supply path which is coupled to a liquid inlet of the liquid ejecting head and through which the liquid is supplied to the liquid ejecting head; a liquid discharge path which is coupled to a liquid outlet of the liquid ejecting head and through which the liquid is discharged from the liquid ejecting head; a supply-side pressure adjustment mechanism that adjusts a pressure in a supply-side liquid chamber provided in the liquid supply path to a first pressure at which a gas-liquid interface formed at the nozzle is maintained; a discharge-side pressure adjustment valve that is provided in the liquid discharge path, includes a discharge-side liquid chamber coupled to the liquid outlet and a discharge-side valve body, and adjusts a pressure of the liquid to be supplied to the liquid ejecting head to a pressure at which the gas-liquid interface formed at the nozzle is maintained, the discharge-side valve body being configured to be opened when a pressure in the discharge-side liquid chamber becomes a second pressure which is lower than the first pressure and a pressure outside the discharge-side liquid chamber and at which the gas-liquid interface formed at the nozzle is maintained, to cause the discharge-side liquid chamber to communicate with a fluid introduction path through which fluid is introduced into the discharge-side liquid chamber from an outside of the discharge-side liquid chamber; and a flow mechanism that is coupled to the discharge-side liquid chamber by a return flow path and is configured to discharge the liquid in the liquid ejecting head toward the liquid discharge path via the discharge-side liquid chamber of the discharge-side pressure adjustment valve.

DESCRIPTION OF EXEMPLARY EMBODIMENTS

First Embodiment

Hereinafter, a first embodiment of a recording apparatus including a liquid ejecting apparatus will be described with reference to the drawings.

Figure 1:
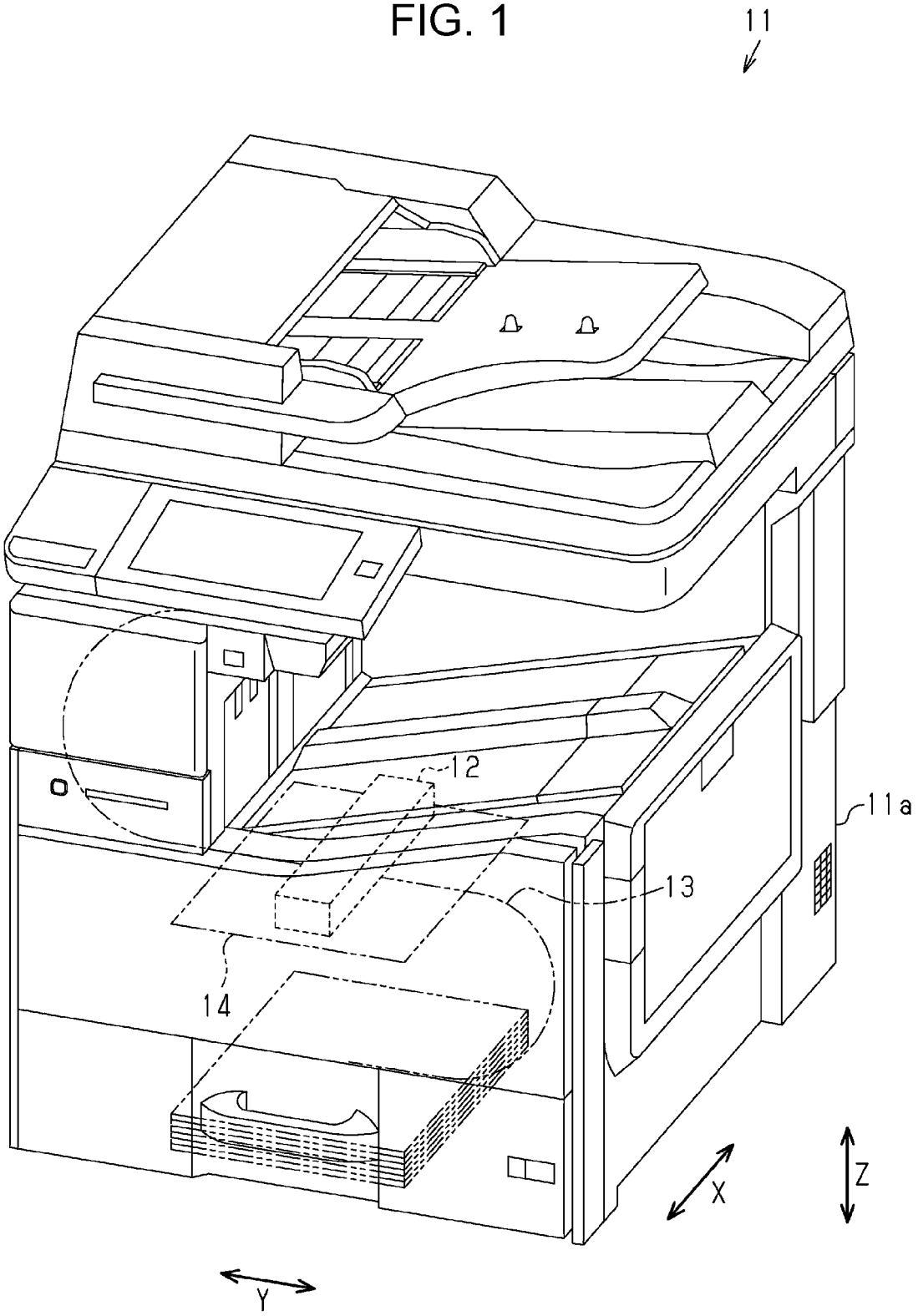
FIG. 1 is a perspective view of a recording apparatus.

As illustrated in FIG. 1, a recording apparatus 11 includes a liquid ejecting apparatus 11*a*, and has a substantially rectangular parallelepiped shape that is long in a vertical direction Z as a whole. The vertical direction Z is a direction of gravity. The liquid ejecting apparatus 11*a* includes a liquid ejecting unit 12 which is capable of ejecting ink as an example of liquid. The liquid ejecting unit 12 performs recording by ejecting liquid to a paper sheet 14 which is transported along a transportation path 13 indicated by a two-dot chain line in FIG. 1. In this embodiment, the liquid ejecting unit 12 is a so-called line head that is capable of simultaneously ejecting ink over a width direction X of the paper sheet 14. The width direction X is a direction along a transportation region where the paper sheet 14 is transported, and is a direction intersecting with (for example, orthogonal to) a transportation direction Y of the paper sheet 14. The transportation region is a planar region along the transportation path 13 and is a region through which the paper sheet 14 transported by a transportation unit passes.

Figure 2:
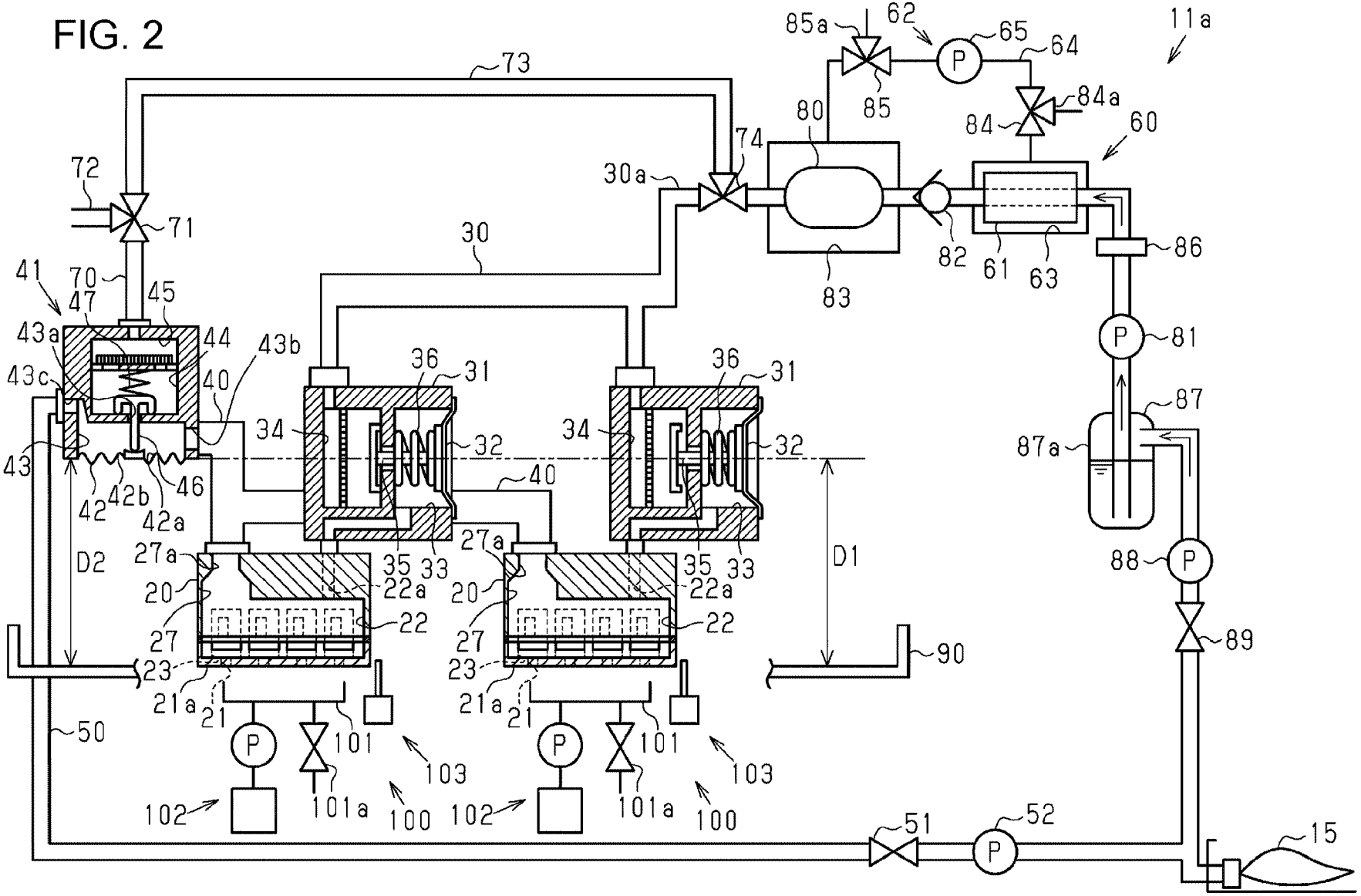
FIG. 2 is a schematic view illustrating a configuration of a liquid ejecting apparatus.

As illustrated in FIG. 2, the liquid ejecting apparatus 11*a* includes a liquid accommodation unit 15 capable of accommodating liquid, liquid ejecting heads 20 that eject liquid, a liquid supply path 30 through which liquid accommodated in the liquid accommodation unit 15 is supplied to each of the liquid ejecting heads 20, and a liquid discharge path 40 through which liquid is discharged from each of the liquid ejecting heads 20. The liquid accommodation unit 15 may be a liquid tank to which liquid can be injected through an injection hole (not illustrated) in a state of being mounted in the recording apparatus 11, and may be a liquid cartridge that is detachable from the recording apparatus 11.

Figure 3:
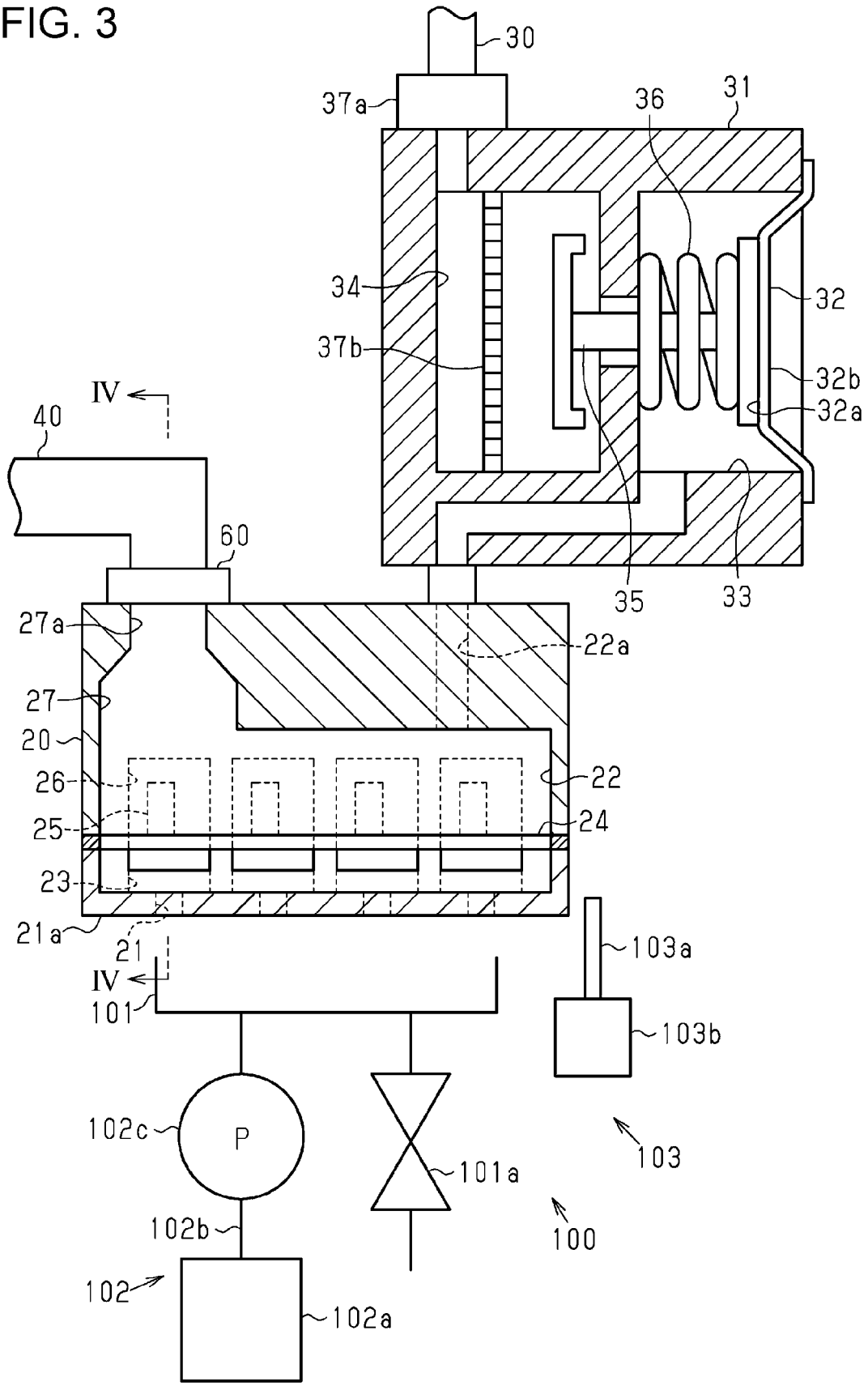
FIG. 3 is a schematic view illustrating a liquid ejecting head, a supply-side pressure adjustment valve, and a maintenance device.
Figure 4:
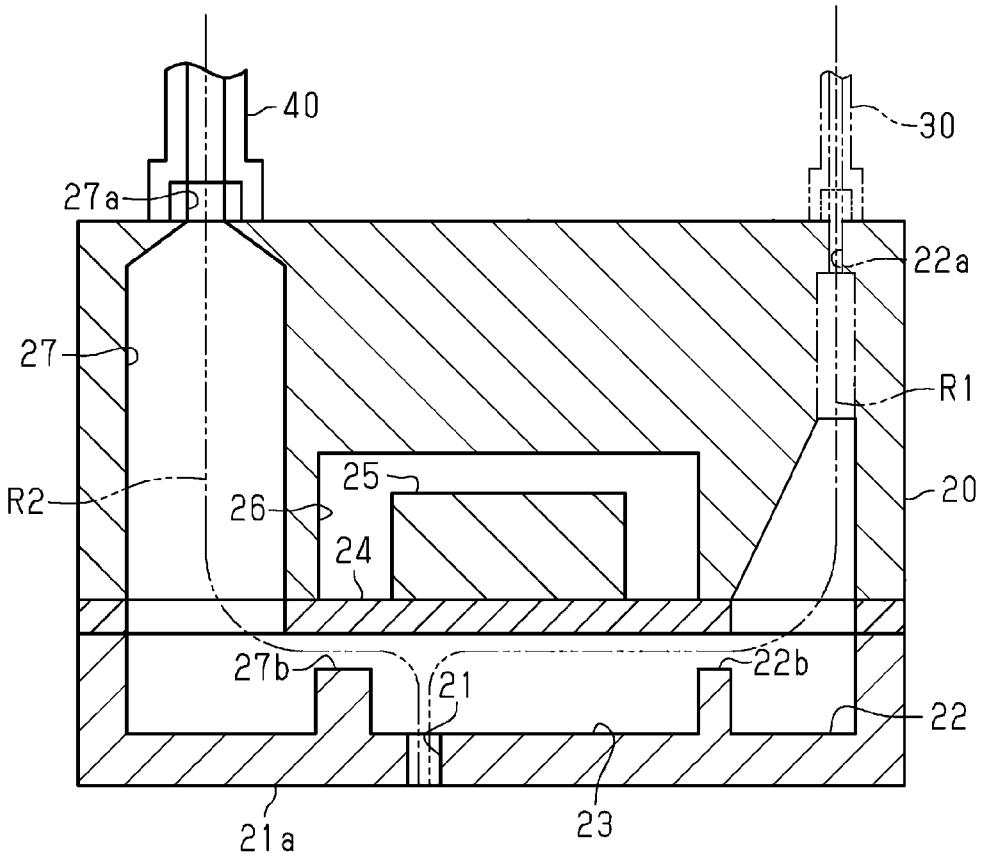
FIG. 4 is a sectional view taken along line IV-IV in FIG. 3.

As illustrated in FIGS. 3 and 4, each liquid ejecting head 20 has a nozzle surface 21*a* in which nozzles 21 capable of ejecting liquid are open. Each liquid ejecting head 20 includes a first common liquid chamber 22 to which liquid is supplied. In the first common liquid chamber 22, a liquid inlet 22*a* coupled to the liquid supply path 30 is open. That is, the liquid supply path 30 is coupled to the liquid inlet 22*a* of each liquid ejecting head 20 to supply liquid to each liquid ejecting head 20.

Each liquid ejecting head 20 includes ejection liquid chambers 23 communicating with the first common liquid chamber 22 via a first communication path 22*b* illustrated in FIG. 4. The nozzles 21 are provided to correspond to the ejection liquid chambers 23. Each ejection liquid chamber 23 communicates with the first common liquid chamber 22 and the nozzle 21. A portion of a wall surface of each ejection liquid chamber 23 is formed by a vibration plate 24.

Each liquid ejecting head 20 includes actuators 25 corresponding to the ejection liquid chambers 23. Each actuator 25 is provided on a surface of the vibration plate 24, the surface being opposite from a portion facing the ejection liquid chamber 23. Each actuator 25 is accommodated in an accommodation chamber 26 disposed at a position different from the first common liquid chamber 22. Each liquid ejecting head 20 discharges liquid, as droplets, in each ejection liquid chamber 23 through each nozzle 21, by the driving of each actuator 25.

The actuator 25 of this embodiment may be configured of a piezoelectric element which contracts when being applied with a drive voltage. In this case, after the vibration plate 24 is deformed according to the contraction of the actuator 25 due to the application of the drive voltage, when the application of the drive voltage to the actuator 25 is released, liquid in the ejection liquid chamber 23 of which the volume is changed is discharged from each nozzle 21 as droplets.

Each liquid ejecting head 20 includes a second common liquid chamber 27 communicating with each ejection liquid chamber 23 via a second communication path 27*b* illustrated in FIG. 4. In the second common liquid chamber 27, a liquid outlet 27*a* coupled to the liquid discharge path 40 is open. That is, the liquid discharge path 40 is coupled to the liquid outlet 27*a* of each liquid ejecting head 20 to discharge liquid from each liquid ejecting head 20.

As illustrated in FIG. 2, the liquid ejecting apparatus 11*a* includes a return flow path 50 that couples the liquid discharge path 40 and the liquid accommodation unit 15, a first on/off valve 51 that closes the return flow path 50 by being in a closed state, a flow pump 52 as an example of a flow mechanism for causing liquid to flow. The flow pump 52 is provided in the return flow path 50 further toward the liquid accommodation unit 15 than the first on/off valve 51.

The liquid supply path 30 is provided with a degassing unit 60 capable of degassing liquid in the liquid supply path 30. The degassing unit 60 can include a cylindrical hollow fiber membrane 61 forming a portion of the liquid supply path 30, and a depressurization mechanism 62 that depressurizes liquid in the liquid supply path 30 for degassing. In this case, the depressurization mechanism 62 includes a depressurization chamber 63 that accommodates the hollow fiber membrane 61, a gas flow path 64 coupled to the depressurization chamber, and a vacuum pump 65 that depressurizes the depressurization chamber 63. When the vacuum pump 65 depressurizes the depressurization chamber 63, liquid inside the hollow fiber membrane 61 is degassed in such a manner that the space outside the hollow fiber membrane 61 is depressurized and gas dissolved in the liquid inside the hollow fiber membrane 61 is sucked outside the hollow fiber membrane 61.

In the liquid supply path 30, supply-side pressure adjustment valves 31 as an example of a supply-side pressure adjustment mechanism that regulate the pressure of liquid to be supplied to each liquid ejecting head 20 are provided between the degassing unit 60 and each liquid ejecting head 20.

As illustrated in FIG. 3, each supply-side pressure adjustment valve 31 includes a supply-side liquid chamber 33 of which the volume is changed by a supply-side flexible portion 32 being bent, a supply-side communication chamber 34 communicating with the supply-side liquid chamber 33, a supply-side valve body 35 capable of shutting off the supply-side liquid chamber 33 and the supply-side communication chamber 34 from each other, and a supply-side bias member 36 that biases the supply-side valve body 35 in a direction of closing the supply-side valve body 35. The supply-side flexible portion 32 forms a wall portion. The supply-side liquid chamber 33 of each supply-side pressure adjustment valve 31 is communicable with the degassing unit 60 via the liquid supply path 30. In addition, the supply-side communication chamber 34 of each supply-side pressure adjustment valve 31 communicates with the first common liquid chamber 22 of each liquid ejecting head 20 via the liquid supply path 30.

In each supply-side pressure adjustment valve 31, foreign matter such as air bubbles is likely to be accumulated on a portion where the cross-sectional area of the flow path is increased, such as the supply-side liquid chamber 33 or the supply-side communication chamber 34, or a portion having a complicated shape such as the supply-side bias member 36. Therefore, in this embodiment, in order to capture foreign matter such as air bubbles, filters 37*a* and 37*b* are provided in an inlet of the supply-side pressure adjustment valve 31 and inside the supply-side pressure adjustment valve 31, respectively. The number or the arrangement of the filters 37*a* and 37*b* can be appropriately changed, and the filters 37*a* and 37*b* may not be provided.

As illustrated in FIG. 2, a discharge-side pressure adjustment valve 41 that regulates the pressure of liquid to be supplied to the liquid ejecting head 20 is provided at a position where the liquid discharge path 40 and the return flow path 50 are coupled. The discharge-side pressure adjustment valve 41 includes a discharge-side liquid chamber 43 of which the volume is changed by a discharge-side flexible portion 42 being bent, a first discharge-side communication chamber 44 communicating with the discharge-side liquid chamber 43 via a first communication hole 43*a*, and a second discharge-side communication chamber 45 communicating with the first discharge-side communication chamber 44. The discharge-side flexible portion 42 forms a wall portion. Further, the discharge-side pressure adjustment valve 41 includes a discharge-side valve body 46 capable of shutting off the discharge-side liquid chamber 43 and the first discharge-side communication chamber 44 from each other, and a discharge-side bias member 47 that biases the discharge-side valve body 46 in a direction of closing the discharge-side valve body 46.

The discharge-side liquid chamber 43 communicates with the liquid discharge path 40 via a second communication hole 43*b*. That is, the discharge-side liquid chamber 43 is coupled to the liquid outlet 27*a* via the liquid discharge path 40. In other words, the liquid discharge path 40 couples the discharge-side liquid chamber 43 and the liquid outlet 27*a* of the second common liquid chamber 27. The discharge-side liquid chamber 43 communicates with the return flow path 50 via a third communication hole 43*c*. In other words, the return flow path 50 couples the discharge-side liquid chamber 43 and the flow pump 52. That is, the flow pump 52 is capable of discharging liquid in each liquid ejecting head 20 toward the liquid discharge path 40 via the discharge-side liquid chamber 43. The discharge-side liquid chamber 43 is capable of communicating with the liquid accommodation unit 15 via the return flow path 50.

The liquid ejecting apparatus 11*a* includes a fluid introduction path 70 which communicates with the second discharge-side communication chamber 45 and through which fluid is introduced into the second discharge-side communication chamber 45. The fluid introduction path 70 is coupled to an atmospheric air communication path 72 through which the atmospheric air as an example of gas can be introduced via a first switch valve 71. The fluid introduction path 70 is coupled to a bypass flow path 73 through which liquid can be introduced from the liquid supply path 30 via the first switch valve 71. The first switch valve 71 is configured to be switchable between a state where the fluid introduction path 70 communicates with the atmospheric air communication path 72, and a state where the fluid introduction path 70 communicates with the bypass flow path 73. The first switch valve 71 may be a 3-way valve including three valve bodies capable of individually closing three flow paths of the fluid introduction path 70, the atmospheric air communication path 72, and the bypass flow path 73, for example.

The atmospheric air communication path 72 is configured such that one end communicates with the fluid introduction path 70 and the other end is open to the atmospheric air, so that the atmospheric air can be introduced into the second discharge-side communication chamber 45 via the fluid introduction path 70. In other words, the fluid introduction path 70 is configured such that the atmospheric air can be introduced into the discharge-side liquid chamber 43 via the second discharge-side communication chamber 45 and the first discharge-side communication chamber 44. The bypass flow path 73 is configured such that one end communicates with the fluid introduction path 70 and the other end is coupled to a portion of the liquid supply path 30, the portion being between the degassing unit 60 and the supply-side pressure adjustment valve 31, so that the atmospheric air can be introduced into the second discharge-side communication chamber 45 via the fluid introduction path 70. That is, the fluid introduction path 70 is coupled to the discharge-side liquid chamber 43 via the second discharge-side communication chamber 45 and the first discharge-side communication chamber 44, and is coupled to an upstream liquid supply path 30*a* via the bypass flow path 73. The upstream liquid supply path 30*a* is, in the liquid supply path 30, upstream of the supply-side liquid chamber 33. In other words, the fluid introduction path 70 is configured to couple the discharge-side liquid chamber 43 to the upstream liquid supply path 30*a*, so that liquid can be introduced into the discharge-side liquid chamber 43.

The liquid ejecting apparatus 11*a* preferably includes a second switch valve 74 at a coupling portion between the bypass flow path 73 and the upstream liquid supply path 30*a*. The second switch valve 74 is capable of switching, between the upstream liquid supply path 30*a* and the bypass flow path 73, a flow path of liquid from the degassing unit 60 to the first common liquid chamber 22 of each liquid ejecting head 20. The second switch valve 74 may be a 3-way valve including three valve bodies capable of individually closing three flow paths of the bypass flow path 73, a portion of the upstream liquid supply path 30*a* that is upstream of the coupling portion with the bypass flow path 73, a portion of the upstream liquid supply path 30*a* that is downstream of the coupling portion with the bypass flow path 73, for example. The liquid ejecting apparatus 11*a* may include at least one of the atmospheric air communication path 72 and the bypass flow path 73. That is, the fluid introduction path 70 may simply communicate with at least one of the atmospheric air communication path 72 and the bypass flow path 73.

In the discharge-side liquid chamber 43, the second communication hole 43*b* is open at a position lower than the first communication hole 43*a* in the vertical direction Z. In other words, the liquid discharge path 40 is open to the discharge-side liquid chamber 43 at a position lower than a position at which fluid having flowed from the fluid introduction path 70 flows into the discharge-side liquid chamber 43.

In addition, in the discharge-side liquid chamber 43, the third communication hole 43*c* is open at a position higher than the first communication hole 43*a* in the vertical direction Z. In other words, the return flow path 50 is open to the discharge-side liquid chamber 43 at a position higher than a position at which fluid having flowed from the fluid introduction path 70 flows into the discharge-side liquid chamber 43.

A temporary storage unit 80 that temporarily stores liquid degassed by the degassing unit 60 is preferably provided between the degassing unit 60 and the second switch valve 74 in the liquid supply path 30. In addition, a pressurization pump 81 that supplies liquid from the degassing unit 60 to each liquid ejecting head 20 in a state where the liquid is pressurized is preferably provided between the degassing unit 60 and the liquid accommodation unit 15 in the liquid supply path 30.

The pressurization pump 81 can function as a liquid flow unit that causes liquid in the liquid supply path 30 to flow. That is, since liquid in the liquid supply path 30 is depressurized in the degassing unit 60, it is possible to efficiently supply liquid to each liquid ejecting head 20 by storing the degassed liquid, which is in a pressurized state by the pressurization pump 81, in the temporary storage unit 80.

A one-way valve 82 is preferably provided between the degassing unit 60 and the temporary storage unit 80 in the liquid supply path 30. The one-way valve 82 allows the flow of liquid from the degassing unit 60 to the temporary storage unit 80, and regulates the flow of liquid from the temporary storage unit 80 to the degassing unit 60. With such a configuration, it is possible to suppress backward flow of liquid from the temporary storage unit 80 in a positive pressure state by the pressurization to the degassing unit 60 in the negative pressure state by the depressurization.

An accommodation bag having flexibility may be adopted as the temporary storage unit 80, the temporary storage unit 80 formed of the accommodation bag may be accommodated in a pressurization chamber 83, and the gas sucked by the vacuum pump 65 for the depressurization may be introduced into the pressurization chamber 83 via the gas flow path 64. In this case, by driving the vacuum pump 65 to introduce gas into the pressurization chamber 83, it is possible to pressurize, via the accommodation bag, liquid inside the accommodation bag.

When such a configuration is adopted, when a first 3-way valve 84 and a second 3-way valve 85 are respectively disposed upstream and downstream of the vacuum pump 65 in the gas flow path 64, it is possible to appropriately set a timing for depressurizing the depressurization chamber 63 and a timing for pressurizing the pressurization chamber 83.

That is, when the depressurization of the depressurization chamber 63 and the pressurization of the pressurization chamber 83 are simultaneously performed, gas in the depressurization chamber 63 may be introduced into the pressurization chamber 83 by closing a first valve 84*a* of the first 3-way valve 84 and a second valve 85*a* of the second 3-way valve 85 and driving the vacuum pump 65. The first valve 84*a* and the second valve 85*a* communicate with the outside. When the depressurization of the depressurization chamber 63 is performed alone, the gas sucked from the depressurization chamber 63 may be discharged to the outside by closing the first valve 84*a*, opening the second valve 85*a*, and driving the vacuum pump 65. Further, when the pressurization of the pressurization chamber 83 is performed alone, the outside gas may be taken into the gas flow path 64 to be introduced into the pressurization chamber 83 by opening the first valve 84*a*, closing the second valve 85*a*, and driving the vacuum pump 65.

It is preferable to include, between the degassing unit 60 and the liquid accommodation unit 15 in the liquid supply path 30, a foreign matter capturing unit that captures foreign matter, such as air bubbles and dust mixed in the liquid, and solidified solute components dissolved in the liquid. For example, the foreign matter capturing unit may be a filter 86 for filtering the liquid or an air trap 87 for capturing air bubbles mixed in the liquid, or may be a combination thereof depending on the foreign matter that is likely to be mixed.

When the air trap 87 includes an air/liquid separation portion 87*a* capable of separating gas from liquid, it is preferable to include a discharge pump 88 causing liquid to flow from the liquid supply path 30 to the air/liquid separation portion 87*a*, and a second on/off valve 89 that is provided closer to the liquid accommodation unit 15 than the discharge pump 88 and closes the liquid supply path 30 by being in a closed state.

The liquid ejecting apparatus 11*a* includes a head holder 90 that holds the liquid ejecting heads 20. The head holder 90 holds the liquid ejecting heads 20 in a state where the nozzle surface 21*a* of each liquid ejecting head 20 is exposed to face downward in the vertical direction Z. The head holder 90 holds the supply-side pressure adjustment valves 31 and the discharge-side pressure adjustment valve 41. The head holder 90 is configured to be displaceable along the vertical direction Z by the driving of a drive unit (not illustrated). The liquid ejecting heads 20, the supply-side pressure adjustment valves 31, and the discharge-side pressure adjustment valve 41 are not movable relative to the head holder 90. That is, the liquid ejecting heads 20, the supply-side pressure adjustment valves 31, and the discharge-side pressure adjustment valve 41 are moved according to the movement of the head holder 90. The liquid ejecting heads 20, the supply-side pressure adjustment valves 31, and the discharge-side pressure adjustment valve 41 are held by the head holder 90 in a state where they are not movable relative to each other.

As illustrated in FIG. 3, the liquid ejecting apparatus 11*a* includes a maintenance device 100 for performing maintenance of the liquid ejecting heads 20. The maintenance device 100 includes a cap 101 that forms a closed space in which the nozzles 21 of each liquid ejecting head 20 are open, a suction mechanism 102, and a wiper unit 103.

The cap 101 is configured to form a closed space when being in contact with the nozzle surface 21*a* of each liquid ejecting head 20. In the following description, forming the closed space by the cap 101 being in contact with the nozzle surface 21*a* of each liquid ejecting head 20 is referred to as capping. The capping can be performed by moving the liquid ejecting heads 20 in a direction to close to the cap 101, or can be performed by moving the cap 101 in a direction to close to the liquid ejecting heads 20. The target that the cap 101 is in contact with at the time of capping is not limited to the nozzle surface 21*a*, and for example, the cap 101 may be in contact with side surface portions of each liquid ejecting head 20 or the head holder 90 holding the liquid ejecting heads 20 to form a closed space where the nozzles 21 are open. A cap opening valve 101*a* for opening the closed space to the atmospheric air is provided to the cap 101.

The suction mechanism 102 includes a waste liquid tank 102*a*, a waste liquid flow path 102*b* that couples the waste liquid tank 102*a* to the cap 101, and a depressurization pump 102*c* disposed at a position in the middle of the waste liquid flow path 102*b*. The wiper unit 103 includes a wiper 103*a* that wipes the nozzle surface 21*a*, and a moving body 103*b* that is moved while holding the wiper 103*a*.

Figure 5:
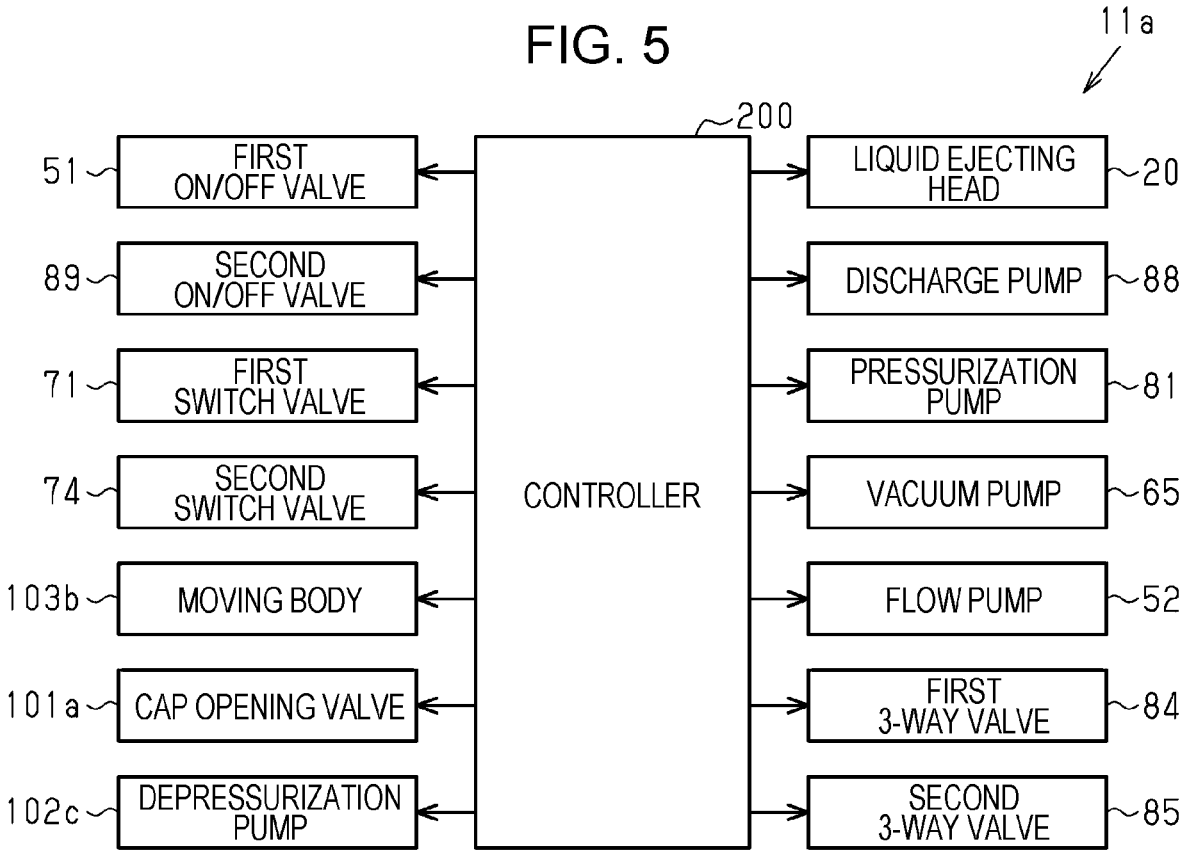
FIG. 5 is a block diagram illustrating an electrical configuration of the liquid ejecting apparatus.

As illustrated in FIG. 5, the liquid ejecting apparatus 11*a* includes a controller 200 that controls constituent elements configuring the liquid ejecting apparatus 11*a*. The controller 200 controls the liquid ejecting heads 20, the flow pump 52, the vacuum pump 65, the pressurization pump 81, the discharge pump 88, and the depressurization pump 102*c*. Further, the controller 200 controls the first on/off valve 51, the second on/off valve 89, the first switch valve 71, the second switch valve 74, the first 3-way valve 84, the second 3-way valve 85, the cap opening valve 101*a*, and the moving body 103*b*. A plurality of controllers 200 may be provided to individually control the constituent elements, or a controller 200 may be provided to comprehensively control constituent elements.

Under the control by the controller 200, the liquid ejecting apparatus 11*a* sets the closed state of the first on/off valve 51 and the cap opening valve 101*a* and the state of the second switch valve 74 in which the flow path of liquid is switched to the liquid supply path 30, as a normal state. In the normal state, the controller 200 performs capping for the liquid ejecting heads 20 by the cap 101 to suppress drying of the nozzles 21.

When the liquid ejecting apparatus 11*a* is activated, the discharge pump 88 and the pressurization pump 81 are controlled to be driven by the controller 200 such that the inside of the temporary storage unit 80 is held at a predetermined positive pressure (pressurized state). In this manner, in the normal state, the temporary storage unit 80, the supply-side communication chamber 34 of each supply-side pressure adjustment valve 31, and the liquid supply path 30 between the temporary storage unit 80 and the supply-side communication chamber 34 are held in a predetermined pressurized state. The controller 200 controls the vacuum pump 65, the first 3-way valve 84, and the second 3-way valve 85 according to the driving of the pressurization pump 81 to perform the depressurization of the depressurization chamber 63, and the degassed liquid is sent to the temporary storage unit 80.

Even when liquid in the supply-side communication chamber 34 of each supply-side pressure adjustment valve 31 is in the pressurized state, while a state where the supply-side valve body 35 shuts off the supply-side liquid chamber 33 and the supply-side communication chamber 34 from each other by the biasing force of the supply-side bias member 36 is held in each supply-side pressure adjustment valve 31, the liquid does not flow from the supply-side communication chamber 34 to the supply-side liquid chamber 33.

Here, the supply-side pressure adjustment valves 31 and the discharge-side pressure adjustment valve 41 of this embodiment will be described in detail.

As illustrated in FIG. 3, the supply-side flexible portion 32 of each supply-side pressure adjustment valve 31 receives the pressure of liquid in the supply-side liquid chamber 33 at a supply-side inner surface 32*a* as an inner surface of the supply-side liquid chamber 33. The supply-side flexible portion 32 receives the atmospheric pressure at a supply-side outer surface 32*b* as an outer surface of the supply-side liquid chamber 33. Therefore, the supply-side flexible portion 32 of each supply-side pressure adjustment valve 31 is bent when the pressure in the supply-side liquid chamber 33 changes. In an example of this embodiment, the pressure in the supply-side liquid chamber 33 refers to the pressure applied to a central portion of the supply-side flexible portion 32.

The supply-side flexible portion 32 is bent when the amount of liquid in the supply-side liquid chamber 33 is changed, and thus the center of the supply-side flexible portion 32 is displaced to change the volume of the supply-side liquid chamber 33. When the amount of liquid in the supply-side liquid chamber 33 is decreased by the liquid being discharged from the supply-side liquid chamber 33, the pressure in the supply-side liquid chamber 33 is decreased, and thus the supply-side flexible portion 32 is bent in a direction in which the volume of the supply-side liquid chamber 33 is decreased. Further, when the amount of liquid in the supply-side liquid chamber 33 is increased by the liquid flowing into the supply-side liquid chamber 33, the pressure in the supply-side liquid chamber 33 is increased, and thus the supply-side flexible portion 32 is bent in a direction in which the volume of the supply-side liquid chamber 33 is increased.

In each supply-side pressure adjustment valve 31, the supply-side valve body 35 is coupled to the supply-side inner surface 32*a* of the supply-side flexible portion 32. The supply-side valve body 35 of each supply-side pressure adjustment valve 31 is moved according to the displacement of the supply-side inner surface 32*a*. The supply-side valve body 35 of each supply-side pressure adjustment valve 31 is opened when the supply-side flexible portion 32 is displaced in a direction in which the volume of the supply-side liquid chamber 33 is decreased, and thereby the supply-side liquid chamber 33 and the supply-side communication chamber 34 communicate with each other. Further, the supply-side valve body 35 of each supply-side pressure adjustment valve 31 is closed when the supply-side flexible portion 32 is displaced in a direction in which the volume of the supply-side liquid chamber 33 is increased, and thereby the supply-side liquid chamber 33 and the supply-side communication chamber 34 are shut off from each other.

In each supply-side pressure adjustment valve 31, the supply-side bias member 36 biases the supply-side valve body 35 in a direction of closing the supply-side valve body 35. In each supply-side pressure adjustment valve 31, the supply-side valve body 35 is opened when the pressure in the supply-side liquid chamber 33 becomes a first pressure (for example, −500 Pa to −1000 Pa relative to the atmospheric pressure in FIG. 2) lower than the atmospheric pressure that is the pressure outside the supply-side liquid chamber 33, and thereby the supply-side liquid chamber 33 and the supply-side communication chamber 34 communicate with each other. The first pressure is determined in accordance with the pressing force of the supply-side bias member 36, force for displacing the supply-side flexible portion 32, a seal load as the pressing force that is required for the supply-side valve body 35 to shut off the supply-side liquid chamber 33 and the supply-side communication chamber 34 from each other, the pressure in the supply-side communication chamber 34 acting on the surface of the supply-side valve body 35, and the pressure in the supply-side liquid chamber 33. That is, as the pressing force of the supply-side bias member 36 is larger, the first pressure for switching the closed state to the open state is lower. That is, the first pressure can be set by determining the pressing force of the supply-side bias member 36.

The first pressure is set to the pressure in the supply-side liquid chamber 33 capable of maintaining the gas-liquid interface formed at the nozzles 21 of each liquid ejecting head 20. In this case, the gas-liquid interface is an interface where the liquid contacts with the gas. The pressure capable of maintaining the gas-liquid interface formed at the nozzles 21 (for example, +500 Pa to −3500 Pa relative to the atmospheric pressure) is a pressure capable of forming the meniscus on the gas-liquid interface at the nozzles 21. The meniscus is a curved liquid surface formed by the liquid contacting the nozzles 21. It is preferable that a concave meniscus suitable for discharging droplets is formed at the nozzle 21. The difference between the pressure applied to the gas-liquid interface formed at the nozzles 21 and the pressure in the supply-side liquid chamber 33 is changed by a distance D1 between the position of the nozzle surface 21*a* and the central position of the supply-side flexible portion 32 in the vertical direction Z. Therefore, the first pressure is set in consideration of the distance D1 (for example, 50 mm in FIG. 2) between the position of the nozzle surface 21*a* and the central position of the supply-side flexible portion 32 in the vertical direction Z. In the following description, the pressure applied to the gas-liquid interface formed at the nozzles 21 indicates the pressure applied to the nozzles 21.

In each supply-side pressure adjustment valve 31, when the pressure in the supply-side liquid chamber 33 becomes the first pressure, the supply-side valve body 35 is opened so that liquid flows into the supply-side liquid chamber 33 from the supply-side communication chamber 34. That is, the supply-side pressure adjustment valve 31 is capable of adjusting the pressure in the supply-side liquid chamber 33 to the first pressure at which the gas-liquid interface formed at the nozzles 21 is maintained. In other words, the supply-side pressure adjustment valve 31 adjusts the pressure of liquid to be supplied to each liquid ejecting head 20 to a pressure at which the gas-liquid interface formed at the nozzles 21 is maintained.

As illustrated in FIG. 2, the discharge-side flexible portion 42 of the discharge-side pressure adjustment valve 41 receives the pressure of liquid in the discharge-side liquid chamber 43 at a discharge-side inner surface 42*a* as an inner surface of the discharge-side liquid chamber 43. The discharge-side flexible portion 42 receives the atmospheric pressure at a discharge-side outer surface 42*b* as an outer surface of the discharge-side liquid chamber 43. Therefore, the discharge-side flexible portion 42 is bent when the pressure in the discharge-side liquid chamber 43 changes. In an example of this embodiment, the pressure in the discharge-side liquid chamber 43 refers to the pressure applied to a central portion of the discharge-side flexible portion 42.

The discharge-side flexible portion 42 is bent when the amount of liquid in the discharge-side liquid chamber 43 is changed, and thus the center of the discharge-side flexible portion 42 is displaced to change the volume of the discharge-side liquid chamber 43. When the amount of liquid in the discharge-side liquid chamber 43 is decreased by the liquid being discharged from the discharge-side liquid chamber 43, the pressure in the discharge-side liquid chamber 43 is decreased, and thus the discharge-side flexible portion 42 is bent in a direction in which the volume of the discharge-side liquid chamber 43 is decreased. When the amount of liquid in the discharge-side liquid chamber 43 is increased by the liquid flowing into the discharge-side liquid chamber 43, the pressure in the discharge-side liquid chamber 43 is increased, and thus the discharge-side flexible portion 42 is bent in a direction in which the volume of the discharge-side liquid chamber 43 is increased.

The discharge-side valve body 46 is disposed to be contactable with the discharge-side inner surface 42*a* of the discharge-side flexible portion 42. The discharge-side valve body 46 is moved according to the displacement of the discharge-side inner surface 42*a* while being in contact with the discharge-side inner surface 42*a*. The discharge-side valve body 46 is opened when the discharge-side flexible portion 42 is displaced in a direction in which the volume of the discharge-side liquid chamber 43 is decreased, and thereby the discharge-side liquid chamber 43 and the first discharge-side communication chamber 44 communicate with each other. The discharge-side valve body 46 is closed when the discharge-side flexible portion 42 is displaced in a direction in which the volume of the discharge-side liquid chamber 43 is increased, and thereby the discharge-side liquid chamber 43 and the first discharge-side communication chamber 44 are shut off from each other.

The discharge-side bias member 47 biases the discharge-side valve body 46 in a direction of closing the discharge-side valve body 46. The discharge-side valve body 46 is opened when the pressure in the discharge-side liquid chamber 43 becomes a second pressure (for example, −1000 Pa to −3500 Pa relative to the atmospheric pressure in FIG. 2) lower than the pressure outside the discharge-side liquid chamber 43 and the first pressure, and thereby the discharge-side liquid chamber 43 and the first discharge-side communication chamber 44 communicate with each other. The second pressure is determined in accordance with the pressing force of the discharge-side bias member 47, force for displacing the discharge-side flexible portion 42, a seal load as the pressing force that is required for the discharge-side valve body 46 to shut off the discharge-side liquid chamber 43 and the first discharge-side communication chamber 44 from each other, the pressure in the first discharge-side communication chamber 44 acting on the surface of the discharge-side valve body 46, and the pressure in the discharge-side liquid chamber 43. That is, as the pressing force of the discharge-side bias member 47 is larger, the second pressure for switching the closed state to the open state is lower. That is, the second pressure can be set by determining the pressing force of the discharge-side bias member 47.

The second pressure is set to the pressure in the discharge-side liquid chamber 43 capable of maintaining the gas-liquid interface formed at the nozzles 21, and the pressure lower than the first pressure. The difference between the pressure applied to the nozzles 21 and the pressure in the discharge-side liquid chamber 43 is changed by a distance D2 between the position of the nozzle surface 21*a* and the central position of the discharge-side flexible portion 42 in the vertical direction Z. Therefore, the second pressure is set in consideration of the distance D2 (for example, 50 mm equal to the D1 in FIG. 2) between the position of the nozzle surface 21*a* and the central position of the discharge-side flexible portion 42 in the vertical direction Z.

In an example of the embodiment, the central position of the discharge-side flexible portion 42 matches the central position of the supply-side flexible portion 32 in the vertical direction Z. That is, in an example of the embodiment, the distance D1 matches the distance D2.

In the discharge-side pressure adjustment valve 41, when the pressure in the discharge-side liquid chamber 43 becomes the second pressure, the discharge-side valve body 46 is opened so that liquid flows into the discharge-side liquid chamber 43 from the first discharge-side communication chamber 44. That is, the discharge-side pressure adjustment valve 41 is capable of adjusting the pressure in the discharge-side liquid chamber 43 to the second pressure at which the gas-liquid interface formed at the nozzles 21 is maintained. In other words, the discharge-side pressure adjustment valve 41 adjusts the pressure of liquid to be supplied to each liquid ejecting head 20 to a pressure at which the gas-liquid interface formed at the nozzles 21 is maintained.

In an example of the embodiment, the area of the discharge-side flexible portion 42 is larger than that of the supply-side flexible portion 32. Therefore, the volume of the discharge-side liquid chamber 43 which is changeable by the discharge-side flexible portion 42 is larger than the volume of the supply-side liquid chamber 33 which is changeable by the supply-side flexible portion 32.

Next, a flow path resistance when liquid is supplied from the supply-side pressure adjustment valves 31 to the liquid ejecting heads 20 and is discharged from the liquid ejecting heads 20 to the discharge-side pressure adjustment valve 41 will be described. In the following description, a direction when liquid flows from the supply-side pressure adjustment valve 31 to the discharge-side pressure adjustment valve 41 via the liquid ejecting head 20 is referred to as a flow path direction.

As illustrated in FIG. 4, the flow path resistance of a second flow path R2 from the nozzle 21 to the discharge-side liquid chamber 43 is smaller than the flow path resistance of a first flow path R1 from the supply-side liquid chamber 33 of the supply-side pressure adjustment valve 31 to the nozzle 21 of the liquid ejecting head 20. The flow path resistance is decreased when the sectional area of the flow path cut in a plane orthogonal to the flow path direction becomes large, and is increased when the sectional area of the flow path cut in a plane orthogonal to the flow path direction becomes small. Further, the flow path resistance is decreased when the length of the flow path in the flow path direction becomes short, and is increased when the length of the flow path in the flow path direction becomes long.

Here, if it is assumed that in a case where a circulation operation is performed when liquid is not ejected from the nozzle 21 of the liquid ejecting head 20, the flow rate of the liquid flowing the first flow path R1 and the second flow path R2 is Qm ($m^3/s$), the first pressure is P1 (Pa), the second pressure is P2 (Pa), the pressure in the nozzle 21 is Pn (Pa), the flow path resistance of the first flow path R1 is Ru (Pa·s/$m^3$), and the flow path resistance of the second flow path R2 is Rd (Pa·s/$m^3$), the following expressions are satisfied.

$$P1-P2=(Ru+Rd)*Qm$$

$$Pn-P2=Rd*Qm \rightarrow Pn=P2+Rd*Qm$$

Further, if it is assumed that in a case where a circulation operation is performed when the liquid is ejected from the nozzle 21 of the liquid ejecting head 20, the flow rate of the liquid flowing the second flow path R2 is Qj ($m^3$/s), and the flow rate of the liquid ejected from the nozzle 21 is U ($m^3$/s), the following expressions are satisfied.

$$P1-P2=Ru*(U+Qj)+Rd*Qj$$

$$Pn-P2=Rd*Qj \rightarrow Pn=P2+Rd*Qj$$

In both cases, in order to accurately maintain the pressure of the liquid in the nozzle 21, it is preferable that the difference between the pressure Pn of the liquid in the nozzle and the second pressure P2 is smaller, and thus it is preferable that the flow path resistance Rd of the second flow path R2 is set to be small.

In an example of the embodiment, the sectional area of the liquid supply path 30 in the first flow path R1, which is cut in a plane orthogonal to the flow path direction is smaller than the sectional area of the liquid discharge path 40 in the second flow path R2, which is cut in a plane orthogonal to the flow path direction. Therefore, the flow path resistance of the liquid discharge path 40 from the liquid ejecting head 20 to the discharge-side pressure adjustment valve 41 is smaller than the flow path resistance of the liquid supply path 30 from the supply-side pressure adjustment valve 31 to the liquid ejecting head 20.

In an example of the embodiment, the sectional area of the second common liquid chamber 27 in the second flow path R2, which is cut in a plane orthogonal to the flow path direction is larger than the sectional area of the first common liquid chamber 22 in the first flow path R1, which is cut in a plane orthogonal to the flow path direction. Therefore, the flow path resistance of the second common liquid chamber 27 from the second communication path 27*b* to the liquid outlet 27*a* is smaller than the flow path resistance of the first common liquid chamber 22 from the liquid inlet 22*a* to the first communication path 22*b*.

Meanwhile, in an example of the embodiment, the length of the flow path of the second communication path 27*b* in the second flow path R2 in the flow path direction is longer than the length of the flow path of the first communication path 22*b* in the first flow path R1 in the flow path direction. Therefore, the flow path resistance of the second communication path 27*b* is larger than the flow path resistance of the first communication path 22*b*.

In an example of the embodiment, the first communication path 22*b* and the second communication path 27*b* are configured such that the flow path resistance of the first communication path 22*b* is smaller than the flow path resistance of the second communication path 27*b* in a range in which the flow path resistance of the second flow path R2 is smaller than the flow path resistance of the first flow path R1. In such a configuration, it is preferable that the first flow path R1 and the second flow path R2 are configured such that the difference between the flow path resistance of the liquid supply path 30 and the first common liquid chamber 22 in the first flow path R1 and the flow path resistance of the liquid discharge path 40 and the second common liquid chamber 27 in the second flow path R2 is larger than the difference between the flow path resistance of the first communication path 22*b* and the flow path resistance of the second communication path 27*b*.

Next, a maintenance operation of maintaining the liquid ejecting apparatus 11*a* and various processes executed by the controller 200 will be described.

The liquid ejecting apparatus 11*a* can execute a circulation operation for circulating liquid in the liquid ejecting apparatus 11*a*, as the maintenance operation. In the liquid ejecting apparatus 11*a*, when the flow of the liquid is stagnant, the liquid tends to thicken or the air bubbles tend to accumulate. In this case, since the state of the nozzle 21 and the ejection liquid chamber 23 is not a normal state, the discharge defects of the liquid by the nozzle 21 easily occur. Therefore, the liquid ejecting apparatus 11*a* is configured to execute the circulation operation for circulating the liquid in the liquid ejecting apparatus 11*a*. Hereinafter, the circulation process for performing the circulation operation will be described.

Figure 6:
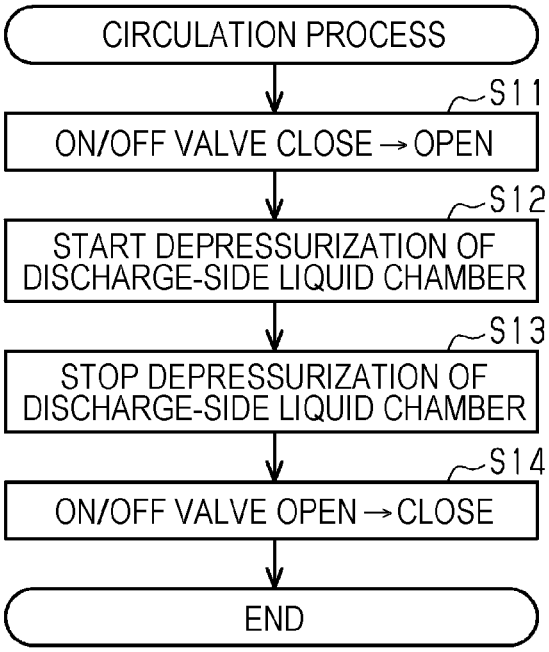
FIG. 6 is a flowchart illustrating an example of a circulation process.

As illustrated in FIG. 6, the controller 200 opens the first on/off valve 51 to cause the flow pump 52 and the discharge-side liquid chamber 43 to communicate with each other, as step S11. The controller 200 drives the flow pump 52 to discharge the liquid in the discharge-side liquid chamber 43 toward the return flow path 50, as step S12. That is, the controller 200 starts depressurization of the discharge-side liquid chamber 43, as step S12. In this manner, the controller 200 circulates the liquid in the liquid ejecting apparatus 11*a*. The flow of the liquid when the liquid is circulated in the liquid ejecting apparatus 11*a* will be described below in detail.

Next, the controller 200 stops the driving of the flow pump 52, as step S13. That is, the controller 200 stops the depressurization of the discharge-side liquid chamber 43, as step S13. Then, the controller 200 closes the first on/off valve 51 to end the circulation process, as step S14.

Here, the flow of the liquid in the circulation operation will be described.

As illustrated in FIG. 2, when the pressure in the discharge-side liquid chamber 43 is higher than the second pressure, the discharge-side valve body 46 is not opened so that the discharge-side liquid chamber 43 and the first discharge-side communication chamber 44 are shut off from each other. Accordingly, when the discharge-side liquid chamber 43 is depressurized, liquid flows into the discharge-side liquid chamber 43 from the second common liquid chamber 27 of each liquid ejecting head 20 via the liquid discharge path 40. In each liquid ejecting head 20, when liquid flows into the discharge-side liquid chamber 43 from the second common liquid chamber 27, since the pressure in the second common liquid chamber 27 is decreased, liquid flows into the second common liquid chamber 27 from the ejection liquid chamber 23 via the second communication path 27*b*. In each liquid ejecting head 20, when liquid flows to the second common liquid chamber 27 from the ejection liquid chamber 23, the pressure in the ejection liquid chamber 23 is decreased. In an example of the embodiment, the second pressure is set to the pressure capable of maintaining the meniscus on the gas-liquid interface of the nozzles 21. Therefore, in a case where the pressure in the discharge-side liquid chamber 43 is higher than the second pressure, when the pressure in the ejection liquid chamber 23 of each liquid ejecting head 20 is decreased, liquid flows into the ejection liquid chamber 23 from the first common liquid chamber 22 while maintaining the meniscus on the gas-liquid interface of the nozzles 21. That is, in a case where the pressure in the discharge-side liquid chamber 43 is higher than the second pressure, when the pressure in the ejection liquid chamber 23 of each liquid ejecting head 20 is decreased, liquid flows from the first common liquid chamber 22 without the atmospheric air being sucked from the nozzles 21. In each liquid ejecting head 20, when the liquid in the first common liquid chamber 22 flows into the ejection liquid chamber 23, since the pressure in the first common liquid chamber 22 is decreased, liquid flows into the first common liquid chamber 22 from the supply-side liquid chamber 33 of each supply-side pressure adjustment valve 31 via the liquid supply path 30.

Then, when the liquid flows into the first common liquid chamber 22 of each liquid ejecting head 20 from the supply-side liquid chamber 33 of each supply-side pressure adjustment valve 31 and the pressure in the supply-side liquid chamber 33 is decreased to the first pressure, the supply-side valve body 35 is opened so that the supply-side liquid chamber 33 and the supply-side communication chamber 34 communicate with each other. In an example of the embodiment, the supply-side communication chamber 34 of each supply-side pressure adjustment valve 31 is held in the pressurized state. Therefore, in each supply-side pressure adjustment valve 31, when the supply-side valve body 35 is opened and the supply-side liquid chamber 33 and the supply-side communication chamber 34 communicate with each other, liquid flows into the supply-side liquid chamber 33 from the supply-side communication chamber 34. In this manner, the pressure in the supply-side liquid chamber 33 of each supply-side pressure adjustment valve 31 is increased to be adjusted to the first pressure.

In an example of the embodiment, the first pressure is set to the pressure in the supply-side liquid chamber 33 which is capable of maintaining the meniscus on the gas-liquid interface of the nozzles 21 of the liquid ejecting head 20. Therefore, in the liquid ejecting apparatus 11*a*, by adjusting the pressure in the supply-side liquid chamber 33 of each supply-side pressure adjustment valve 31 to the first pressure, it is possible to maintain the meniscus on the gas-liquid interface of the nozzles 21 of each liquid ejecting head 20.

Meanwhile, in an example of the embodiment, the second pressure is set to the pressure in the discharge-side liquid chamber 43 which is capable of maintaining the meniscus on the gas-liquid interface of the nozzles 21 of the liquid ejecting head 20, and the pressure lower than the first pressure. Therefore, when the liquid in the discharge-side liquid chamber 43 is discharged toward the return flow path 50 in the circulation process, in principle, the pressure in the supply-side liquid chamber 33 of each supply-side pressure adjustment valve 31 is decreased to the first pressure and the supply-side valve body 35 is opened, before the pressure in the discharge-side liquid chamber 43 is decreased to the second pressure and the discharge-side valve body 46 is opened. Accordingly, in the liquid ejecting apparatus 11*a*, it is possible to supply liquid to the ejection liquid chamber 23 from the supply-side communication chamber 34 of each supply-side pressure adjustment valve 31 via the supply-side liquid chamber 33, the liquid supply path 30, and the first common liquid chamber 22 before the pressure in the discharge-side liquid chamber 43 becomes the second pressure. Therefore, in the liquid ejecting apparatus 11*a*, it is possible to adjust the pressure in the ejection liquid chamber 23 of each liquid ejecting head 20 to the pressure capable of maintaining the meniscus on the gas-liquid interface of the nozzles 21.

Note that, it is assumed that the pressure in the discharge-side liquid chamber 43 becomes the second pressure temporarily, due to the discharge amount of the liquid when the liquid is discharged from the discharge-side liquid chamber 43 toward the return flow path 50 by the driving of the flow pump 52. For example, it is assumed that the pressure in the discharge-side liquid chamber 43 reaches the second pressure when the discharge amount of the liquid when the liquid is discharged from the discharge-side liquid chamber 43 toward the return flow path 50 exceeds the discharge amount of the liquid from the supply-side communication chamber 34 of each supply-side pressure adjustment valve 31 to the supply-side liquid chamber 33.

In this case, the discharge-side valve body 46 is opened so that the discharge-side liquid chamber 43 and the first discharge-side communication chamber 44 to communicate with each other. Therefore, the fluid introduced from the fluid introduction path 70 into the second discharge-side communication chamber 45 flows into the discharge-side liquid chamber 43 via the first discharge-side communication chamber 44. In this manner, the pressure in the discharge-side liquid chamber 43 is increased and adjusted to the second pressure. Therefore, in the liquid ejecting apparatus 11*a*, by adjusting the pressure in the discharge-side liquid chamber 43 to the second pressure, it is possible to maintain the meniscus on the gas-liquid interface of the nozzles 21.

The controller 200 can cause the atmospheric air to flow into the discharge-side liquid chamber 43 by switching the first switch valve 71 to the state of allowing the communication between the fluid introduction path 70 and the atmospheric air communication path 72 when the fluid flows into the discharge-side liquid chamber 43 from the fluid introduction path 70 via the second discharge-side communication chamber 45 and the first discharge-side communication chamber 44. Further, the controller 200 can cause the liquid to flow into the discharge-side liquid chamber 43 from the temporary storage unit 80 by switching the first switch valve 71 to the state of allowing the communication between the fluid introduction path 70 and the bypass flow path 73 when the fluid flows into the discharge-side liquid chamber 43 from the fluid introduction path 70 via the second discharge-side communication chamber 45 and the first discharge-side communication chamber 44.

As described above, in the circulation operation, liquid is circulated in the liquid ejecting apparatus 11*a* while maintaining the meniscus on the gas-liquid interface of the nozzles 21.

The liquid ejecting apparatus 11*a* may be configured to execute wiping for wiping the nozzle surface 21*a* with the wiper 103*a*, as the maintenance operation. The wiping can be performed for removing foreign matter such as liquid or dust attached to the nozzle surfaces 21*a*. The controller 200 can execute the wiping by the moving body 103*b* being moved along the nozzle surface 21*a* in a state where the tip end of the wiper 103*a* is in contact with the nozzle surface 21*a*. The wiping can alternatively be performed by the liquid ejecting head 20 being moved in a state where the liquid ejecting head 20 is in contact with the wiper 103*a*.

The liquid ejecting apparatus 11*a* may be configured to execute flushing for discharging the liquid in the nozzles 21 by ejecting the liquid from the nozzles 21 of each liquid ejecting head 20 toward the cap 101, as the maintenance operation. The flushing can be performed for preventing or eliminating the clogging of the nozzles 21 during the printing, for example, or can be performed for preparing the meniscus of the liquid to be formed at the nozzles 21 after the wiping, for example.

Further, the liquid ejecting apparatus 11*a* may be configured to execute a cleaning operation for discharging the liquid from the ejection liquid chamber 23 via the nozzles 21, as the maintenance operation. It can be said that the cleaning operation is an operation having a greater effect of eliminating the clogging of the nozzles 21 than the flushing since the amount of liquid discharged from the nozzles 21 is larger than that by the flushing.

The liquid ejecting apparatus 11*a* may be configured to execute suction cleaning, as the cleaning operation. The controller 200 can perform the suction cleaning by driving the depressurization pump 102*c* in a state where the capping is performed to decrease the pressure of the closed space and the liquid is discharged from the nozzles 21.

Further, the liquid ejecting apparatus 11*a* may be configured to execute pressurization cleaning, as the cleaning operation. Hereinafter, a pressurization cleaning process for performing the pressurization cleaning will be described.

Figure 7:
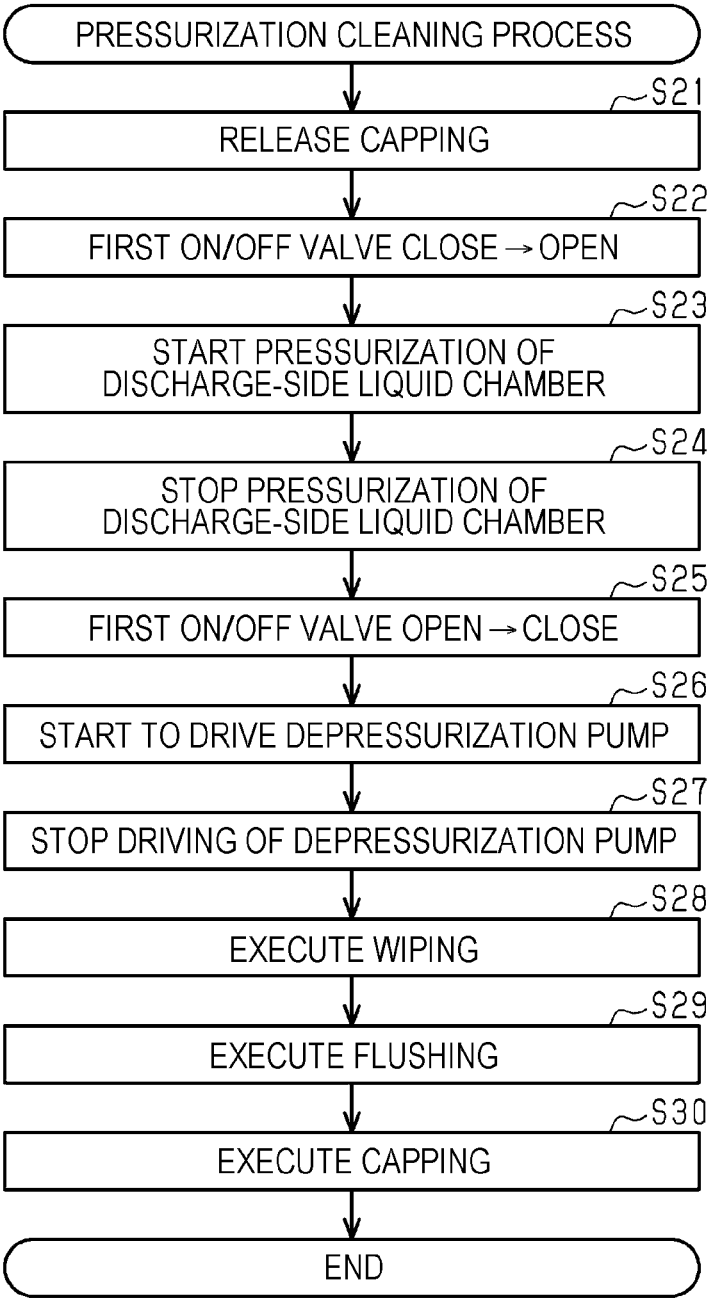
FIG. 7 is a flowchart illustrating an example of a pressurization cleaning process.

As illustrated in FIG. 7, the controller 200 releases the capping of the liquid ejecting heads 20, as step S21. When the capping is released, the cap 101 is disposed at a position to face the opening of the nozzle surface 21*a*.

Next, the controller 200 opens the first on/off valve 51 to cause the flow pump 52 and the discharge-side liquid chamber 43 to communicate with each other, as step S22. Then, as step S23, the controller 200 drives the flow pump 52 to start pressurization of the discharge-side liquid chamber 43. When the pressure in the discharge-side liquid chamber 43 is increased, the discharge-side valve body 46 is closed so that the discharge-side liquid chamber 43 and the first discharge-side communication chamber 44 are shut off from each other. Therefore, when the pressure in the discharge-side liquid chamber 43 is increased, the liquid stored in the discharge-side liquid chamber 43 is pressurized and supplied to the second common liquid chamber 27 of each liquid ejecting head 20 via the liquid discharge path 40. Then, the liquid in the second common liquid chamber 27 flows into the ejection liquid chamber 23, flows out from the nozzles 21, and is received by the cap 101. In this manner, foreign matter that causes ejecting failure, such as liquid thickened by evaporation of solvent components, or air bubbles in the second common liquid chamber 27 or the ejection liquid chamber 23, are discharged together with the liquid via the nozzles 21.

When a sufficient amount of liquid for discharging foreign matter is discharged from the nozzles 21, the controller 200 stops the driving of the flow pump 52, and stops the pressurization of the discharge-side liquid chamber 43, as step S24. Further, the controller 200 closes the first on/off valve 51 to shut off the flow pump 52 and the discharge-side liquid chamber 43 from each other, as step S25.

Next, the controller 200 starts to drive the depressurization pump 102*c*, as step S26. In this manner, the liquid accumulated in the cap 101 is discharged to the waste liquid tank 102*a* via the waste liquid flow path 102*b*. When the discharge of the liquid in the cap 101 is ended, the controller 200 stops the driving of the depressurization pump 102*c*, as step S27.

Then, the controller 200 moves the moving body 103*b* to execute the wiping, as step S28. In this manner, liquid droplets and the like attached to the nozzle surface 21*a* are removed with the discharge of the liquid from the nozzles 21.

The controller 200 executes the flushing to prepare the meniscus of the nozzles 21 as step S29, and executes the capping as step S30 to end the pressurization cleaning process. When the printing is performed immediately after the execution of the pressurization cleaning, or the like, the capping in step S30 may not be performed.

Next, actions of the liquid ejecting apparatus 11*a* of the embodiment will be described.

In a case where a circulation operation for circulating the liquid in the liquid ejecting apparatus 11*a* is performed, in the discharge-side pressure adjustment valve 41, when the pressure in the discharge-side liquid chamber 43 becomes the second pressure, the discharge-side flexible portion 42 is bent to open the discharge-side valve body 46, and thus the liquid flows into the discharge-side liquid chamber 43 from the fluid introduction path 70. Therefore, in the discharge-side pressure adjustment valve 41, the pressure in the discharge-side liquid chamber 43 is adjusted to the second pressure capable of forming the meniscus on the gas-liquid interface of the nozzles 21 even when the liquid is discharged toward the return flow path 50 in the circulation operation.

In addition, in a case where the circulation operation is performed, when the pressure in the supply-side liquid chamber 33 becomes the first pressure, in the supply-side pressure adjustment valve 31, the supply-side resilient portion 32 is bent to open the supply-side valve body 35, and thus the liquid flows into the supply-side liquid chamber 33 from the supply-side communication chamber 34. Therefore, in the supply-side pressure adjustment valve 31, the pressure in the supply-side liquid chamber 33 is adjusted to the first pressure capable of forming the meniscus on the gas-liquid interface of the nozzles 21 even when the liquid is discharged toward the return flow path 50 in the circulation operation.

The liquid discharge path 40 is coupled to the discharge-side liquid chamber 43 via the second communication hole 43*b* that is provided at a position, in the vertical direction Z, lower than the first communication hole 43*a* through which the fluid having flowed from the fluid introduction path 70 flows into the discharge-side liquid chamber 43. Therefore, in the liquid ejecting apparatus 11*a*, it is possible to suppress the fluid, which has flowed from the fluid introduction path 70, flowing toward the second communication hole 43*b*.

The return flow path 50 is coupled to the discharge-side liquid chamber 43 via the third communication hole 43*c* at a position, in the vertical direction Z, higher than the first communication hole 43*a* through which the fluid having flowed from the fluid introduction path 70 flows into the discharge-side liquid chamber 43. Therefore, in the liquid ejecting apparatus 11*a*, it is possible to guide the fluid, which has flowed from the fluid introduction path 70, toward the third communication hole 43*c*.

The fluid introduction path 70 is communicable with the bypass flow path 73 which is coupled to the upstream liquid supply path 30*a* that is upstream of the supply-side liquid chamber 33 in the liquid supply path 30. Therefore, in the liquid ejecting apparatus 11*a*, it is possible to cause liquid, which is the same as the liquid to be supplied from the liquid supply path 30 to each liquid ejecting head 20, to flow into the discharge-side liquid chamber 43 from the fluid introduction path 70.

The fluid introduction path 70 can be coupled to the atmospheric air communication path 72. Therefore, in the liquid ejecting apparatus 11*a*, it is possible to cause the atmospheric air to flow into the discharge-side liquid chamber 43 from the fluid introduction path 70.

The difference between the pressure applied to the nozzles 21 and the pressure in the discharge-side liquid chamber 43 during the circulation operation is increased as the flow path resistance from the discharge-side liquid chamber 43 to the nozzle 21 is increased. In an example of the embodiment, the flow path resistance of the second flow path R2 from the nozzle 21 to the discharge-side liquid chamber 43 is smaller than the flow path resistance of the first flow path R1 from the supply-side liquid chamber 33 to the nozzle 21. Therefore, the difference between the pressure in the discharge-side liquid chamber 43 and the pressure applied to the nozzles 21 can be decreased.

The flow path resistance of the second communication path 27*b* is larger than the flow path resistance of the first communication path 22*b*. Therefore, when the liquid is discharged from the nozzles 21, it is possible to cause the liquid to easily flow into the ejection liquid chamber 23 from the first common liquid chamber 22, and it is possible to suppress the liquid flowing into the ejection liquid chamber 23 from the second common liquid chamber 27.

In the discharge-side pressure adjustment valve 41, when the liquid is discharged from the discharge-side liquid chamber 43 toward the return flow path 50, the discharge-side flexible portion 42 is bent to reduce the volume of the discharge-side liquid chamber 43. Therefore, when the liquid is discharged from the discharge-side liquid chamber 43 toward the return flow path 50, the discharge-side pressure adjustment valve 41 can reduce the amount of the liquid sucked from the second common liquid chamber 27, of each liquid ejecting head 20, which is coupled to the discharge-side liquid chamber 43 via the liquid discharge path 40. That is, the discharge-side pressure adjustment valve 41 can reduce the pressure fluctuation generated in each liquid ejecting head 20 when the liquid is discharged from the discharge-side liquid chamber 43 toward the return flow path 50. Further, the volume of the discharge-side liquid chamber 43 which is changeable by the discharge-side flexible portion 42 is larger than the volume of the supply-side liquid chamber 33 which is changeable by the supply-side flexible portion 32. Therefore, the discharge-side pressure adjustment valve 41 can preferably reduce the pressure fluctuation even when the amount of the liquid to be discharged from the discharge-side liquid chamber 43 toward the return flow path 50 is large.

The liquid ejecting heads 20, the supply-side pressure adjustment valves 31, and the discharge-side pressure adjustment valve 41 are held by the head holder 90 in a state where they are not movable relative to each other. Therefore, the distance between the nozzle surface 21*a* and the supply-side pressure adjustment valve 31 in the vertical direction Z is not changed even when the head holder 90 is displaced along the vertical direction Z. Accordingly, in an example of the embodiment, it is possible to suppress the change of the pressure applied to the nozzles 21 due to the change of the distance between the nozzle surface 21*a* and the supply-side pressure adjustment valve 31 in the vertical direction Z.

Further, the distance between the nozzle surface 21*a* and the discharge-side pressure adjustment valve 41 in the vertical direction Z is not changed even when the head holder 90 is displaced along the vertical direction Z. Accordingly, in an example of the embodiment, it is possible to suppress the change of the pressure applied to the nozzles 21 due to the change of the distance between the nozzle surface 21*a* and the discharge-side pressure adjustment valve 41 in the vertical direction Z.

Effects of the embodiment will be described.

(1) The liquid ejecting apparatus 11*a* includes the discharge-side pressure adjustment valve 41 in the liquid discharge path 40 through which the liquid is discharged from each liquid ejecting head 20. Therefore, the liquid ejecting apparatus 11*a* can reduce the pressure fluctuation in the nozzles 21 when the liquid is discharged from the liquid outlet 27*a* by driving the flow pump 52 in the circulation operation for circulating the liquid. Accordingly, the liquid ejecting apparatus 11*a* can suppress the pressure control at the time of performing the circulation operation being complicated.

(2) The liquid ejecting apparatus 11*a* can adjust the pressure in the supply-side liquid chamber 33 by the supply-side pressure adjustment valve 31. Therefore, the liquid ejecting apparatus 11*a* can easily control the pressure in the supply-side liquid chamber 33 as compared with the related art in which the pressure in the supply-side liquid chamber 33 is adjusted by using the pump and the sensor, for example.

(3) Since the pressure fluctuation in the supply-side liquid chamber 33 can be reduced by bending the supply-side flexible portion 32, the liquid ejecting apparatus 11*a* can easily control the pressure in the supply-side liquid chamber 33.

(4) Since the pressure fluctuation in the discharge-side liquid chamber 43 can be reduced by bending the discharge-side flexible portion 42, the liquid ejecting apparatus 11*a* can easily control the pressure in the discharge-side liquid chamber 43.

(5) The liquid ejecting apparatus 11*a* can suppress the fluid, which has flowed into the discharge-side liquid chamber 43 from the fluid introduction path 70, flowing toward the liquid discharge path 40.

(6) The liquid ejecting apparatus 11*a* can efficiently discharge the fluid, which has flowed into the discharge-side liquid chamber 43 from the fluid introduction path 70, from the discharge-side liquid chamber 43 via the return flow path 50.

(7) The liquid ejecting apparatus 11*a* can maintain the pressure in the discharge-side liquid chamber 43 by introducing the liquid, which is the same as the liquid to be supplied to each liquid ejecting head 20, into the discharge-side liquid chamber 43 when the discharge-side liquid chamber 43 becomes the second pressure.

(8) The liquid ejecting apparatus 11*a* can discharge the liquid in the discharge-side pressure adjustment valve 41 and the return flow path 50 via the return flow path 50 by driving the flow pump 52 such that the pressure in the discharge-side liquid chamber 43 becomes lower than the second pressure in a state where the first switch valve 71 is switched to the state of allowing the communication between the fluid introduction path 70 and the atmospheric air communication path 72.

(9) The liquid ejecting apparatus 11*a* can introduce the atmospheric air into the discharge-side liquid chamber 43 by driving the flow pump 52 such that the pressure in the discharge-side liquid chamber 43 becomes lower than the second pressure in a state where the first switch valve 71 is switched to the state of allowing the communication between the fluid introduction path 70 and the atmospheric air communication path 72. Therefore, in a case where ink that solidifies when the amount of oxygen in the liquid is decreased is used as an example of the liquid, solidification of the liquid can be suppressed.

(10) Since the liquid ejecting apparatus 11*a* includes the degassing unit 60, the liquid ejecting apparatus 11*a* can suppress the liquid containing the atmospheric air being supplied to each liquid ejecting head 20 even when the atmospheric air is introduced into the discharge-side liquid chamber 43.

(11) In the liquid ejecting apparatus 11*a*, the flow path resistance of the second flow path R2 from the nozzle 21 to the discharge-side liquid chamber 43 is smaller than the flow path resistance of the first flow path R1 from the supply-side liquid chamber 33 to the nozzle 21. Therefore, the difference between the pressure in the discharge-side liquid chamber 43 and the pressure applied to the nozzles 21 can be decreased. Accordingly, it is possible to accurately adjust the pressure applied to the nozzle 21 by adjusting the pressure in the discharge-side liquid chamber 43.

(12) In the liquid ejecting apparatus 11*a*, when the liquid is discharged from the nozzles 21, it is possible to cause the liquid to easily flow into the ejection liquid chamber 23 from the first common liquid chamber 22, and it is possible to suppress the liquid flowing into the ejection liquid chamber 23 from the second common liquid chamber 27. Therefore, when the liquid is discharged from the nozzles 21, it is possible to cause the liquid to flow into the ejection liquid chamber 23 from the liquid supply path 30.

(13) The discharge-side pressure adjustment valve 41 can reduce the pressure fluctuation generated in each liquid ejecting head 20 when the liquid is discharged from the discharge-side liquid chamber 43 toward the return flow path 50 in the circulation operation. Therefore, the liquid ejecting apparatus 11*a* can reduce the fluctuation of the pressure applied to the nozzles 21 during the circulation operation.

(14) The volume of the discharge-side liquid chamber 43 which is changeable by the discharge-side flexible portion 42 is larger than the volume of the supply-side liquid chamber 33 which is changeable by the supply-side flexible portion 32. Therefore, the discharge-side pressure adjustment valve 41 can preferably reduce the pressure fluctuation in the discharge-side liquid chamber 43 by reducing the volume of the discharge-side liquid chamber 43 due to the displacement of the discharge-side flexible portion 42 even when the amount of the liquid to be discharged from the discharge-side liquid chamber 43 toward the return flow path 50 is large. Therefore, the liquid ejecting apparatus 11*a* can preferably reduce the fluctuation of the pressure applied to the nozzles 21.

(15) The liquid ejecting heads 20 and the supply-side pressure adjustment valves 31 are held by the head holder 90 in a state where they are not movable relative to each other. Therefore, the liquid ejecting apparatus 11*a* can suppress the change of the pressure applied to the nozzles 21 due to the change of the distance between the nozzle surface 21*a* and the supply-side pressure adjustment valve 31 in the vertical direction Z when the head holder 90 is displaced.

(16) The liquid ejecting heads 20 and the discharge-side pressure adjustment valve 41 are held by the head holder 90 in a state where they are not movable relative to each other. Therefore, the liquid ejecting apparatus 11*a* can suppress the change of the pressure applied to the nozzles 21 due to the change of the distance between the nozzle surface 21*a* and the discharge-side pressure adjustment valve 41 in the vertical direction Z when the head holder 90 is displaced.

Second Embodiment

Next, a second embodiment of a liquid ejecting apparatus and a control method for the liquid ejecting apparatus will be described with reference to the drawings. The second embodiment is different from the first embodiment in that the discharge-side pressure adjustment valve 41, the return flow path 50, and the fluid introduction path 70 are not provided and the pressure applied to the nozzles 21 is adjusted in accordance with the position where a liquid tank as an example of the liquid accommodation unit 15 is disposed. Since in other points, the second embodiment is substantially the same as the first embodiment, the same reference numerals are given to the same configuration, and the duplicated description is omitted.

Figure 8:
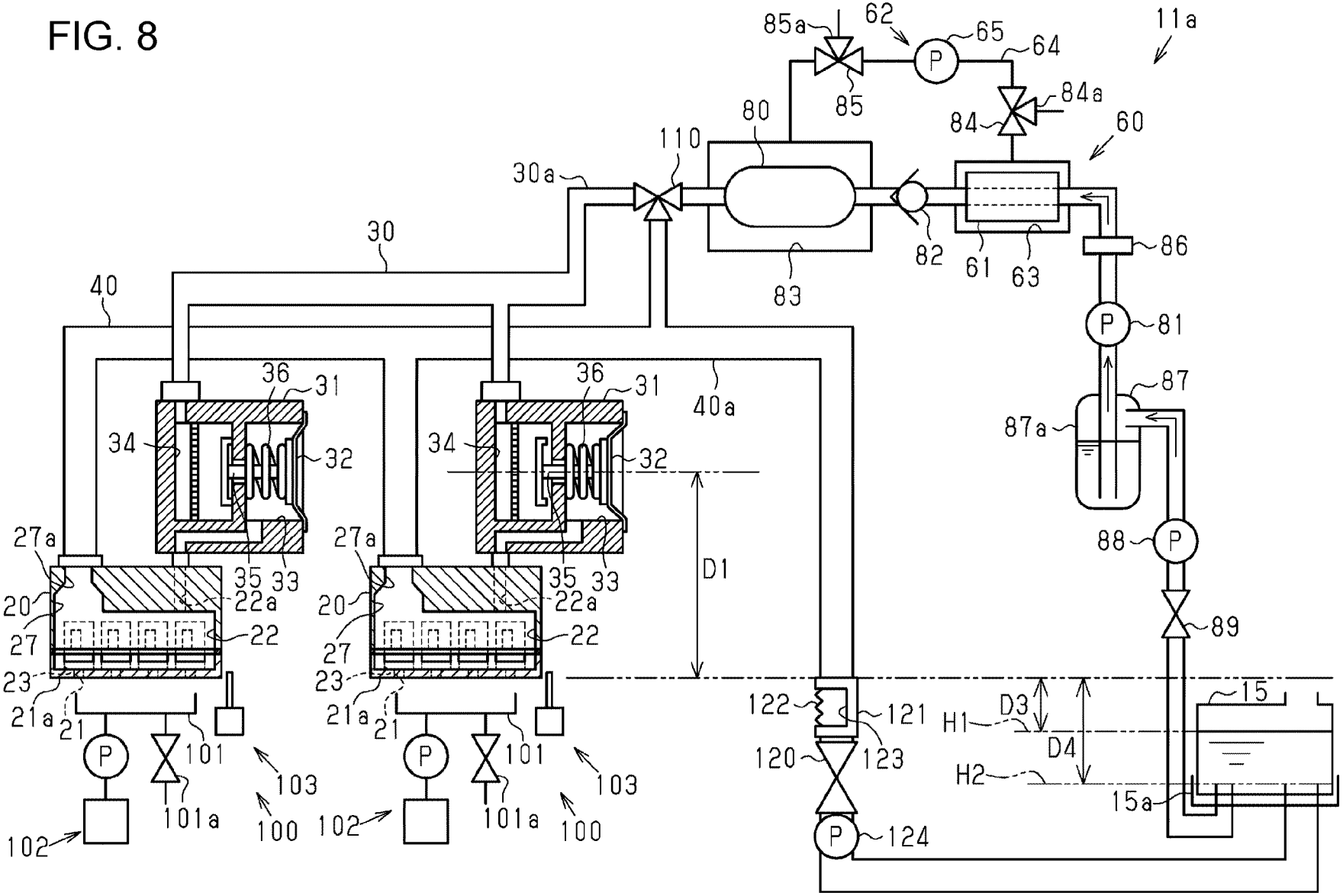
FIG. 8 is a schematic view illustrating a configuration of a liquid ejecting apparatus according to a second embodiment.

As illustrated in FIG. 8, the liquid discharge path 40 is coupled to a portion of the liquid supply path 30, the portion being between the degassing unit 60 and the supply-side pressure adjustment valve 31. That is, the liquid discharge path 40 is coupled to the upstream liquid supply path 30*a* that is upstream of the supply-side liquid chamber 33 in the liquid supply path 30.

The liquid ejecting apparatus 11*a* preferably includes a third switch valve 110 at a coupling portion between the liquid discharge path 40 and the liquid supply path 30. The third switch valve 110 is capable of switching a flow path of liquid from the degassing unit 60 to the first common liquid chamber 22 of each liquid ejecting head 20, between the upstream liquid supply path 30*a* and the liquid discharge path 40. The third switch valve 110 may be a 3-way valve including three valve bodies capable of individually closing three flow paths of the liquid discharge path 40, a portion of the upstream liquid supply path 30*a* that is upstream of the coupling portion with the liquid discharge path 40, a portion of the upstream liquid supply path 30*a* that is downstream of the coupling portion with the liquid discharge path 40, for example.

The liquid discharge path 40 branches off from a portion between the liquid ejecting head 20 and the third switch valve 110, and is coupled to the liquid accommodation unit 15 as an example of the liquid storage unit. That is, the liquid discharge path 40 includes a branch portion 40*a* that branches. The liquid ejecting apparatus 11*a* includes a third on/off valve 120 as an example of a storage unit pressure adjustment mechanism provided between the liquid ejecting head 20 and the liquid accommodation unit 15 in the liquid discharge path 40. The third on/off valve 120 becomes in a closed state to close the liquid discharge path 40 on a side closer to the liquid accommodation unit 15 than the branch portion 40*a*. In other words, the third on/off valve 120 becomes in an open state to cause the liquid accommodation unit 15 and the liquid ejecting head 20 to communicate with each other via the liquid discharge path 40. That is, the third on/off valve 120 becomes in an open state to cause the pressure in the liquid accommodation unit 15 to act on the nozzles 21 via the liquid discharge path 40. In an example of the embodiment, the pressure in the liquid accommodation unit 15 is determined by the pressure applied to the liquid level of the liquid accommodated in the liquid accommodation unit 15. The pressure in the liquid accommodation unit 15 may be determined by the pressure applied to any position in the liquid accommodation unit 15.

The liquid ejecting apparatus 11*a* includes a pressure damper 121 which reduces the fluctuation of the pressure in the liquid discharge path 40, between the branch portion 40*a* and the third on/off valve 120 in the liquid discharge path 40. That is, the liquid ejecting apparatus 11*a* includes the pressure damper 121 between the liquid ejecting head 20 and the third on/off valve 120 in the liquid discharge path 40. The pressure damper 121 includes a pressure adjustment chamber 123 of which the volume is changed by a pressure-adjustment flexible portion 122 being bent. The pressure-adjustment flexible portion 122 forms a wall portion. In the pressure damper 121, the pressure-adjustment flexible portion 122 is bent so as to increase the volume of the pressure adjustment chamber 123 when the amount of the liquid in the liquid discharge path 40 is increased, and the pressure-adjustment flexible portion 122 is bent so as to decrease the volume of the pressure adjustment chamber 123 when the amount of the liquid in the liquid discharge path 40 is decreased. In this manner, the liquid ejecting apparatus 11*a* can reduce the pressure fluctuation in the liquid discharge path 40. The liquid ejecting apparatus 11*a* includes a discharge flow pump 124 which causes the liquid to flow, between the third on/off valve 120 and the liquid accommodation unit 15 in the liquid discharge path 40.

The liquid ejecting apparatus 11*a* includes a holding unit 15*a* that holds the liquid accommodation unit 15. The liquid accommodation unit 15 is held by the holding unit 15*a* such that the position of the liquid level in the liquid accommodation unit 15 in the vertical direction Z is within a range from a first position H1 to a second position H2. The first position H1 is a position of the liquid level when the maximum amount of the liquid that can be accommodated in the liquid accommodation unit 15 is accommodated. The second position H2 is a position of the liquid level when the minimum amount of the liquid that can be supplied from the liquid accommodation unit 15 to the liquid supply path 30 is accommodated.

In an example of the embodiment, the first position H1 and the second position H2 are positions of the liquid level in the liquid accommodation unit 15 when the pressure as the potential energy of the liquid in the liquid accommodation unit 15 in a case where the liquid accommodation unit 15 is opened to the atmospheric air becomes a pressure which is lower than the first pressure and at which the gas-liquid interface formed at the nozzle 21 is maintained, as illustrated in FIG. 8. That is, in an example of the embodiment, the pressure in the liquid accommodation unit 15 is adjusted to the second pressure which is lower than the first pressure and at which the gas-liquid interface formed at the nozzle 21 is maintained, by the liquid accommodation unit 15 being held by the holding unit 15*a*. That is, the holding unit 15*a* holds the liquid accommodation unit 15 at a position at which the pressure in the liquid accommodation unit 15 acting on the nozzle 21 via the liquid discharge path 40 becomes the second pressure.

In this case, the difference between the pressure applied to the nozzles 21 and the pressure in the liquid accommodation unit 15 is changed by the distance between the position of the nozzle surface 21*a* and the position of the liquid level in the liquid accommodation unit 15 in the vertical direction Z. Therefore, the pressure applied to the nozzles 21 when the position of the liquid level in the liquid accommodation unit 15 is the first position H1 is changed by a distance D3 between the position of the nozzle surface 21*a* and the first position H1 in the vertical direction Z. Further, the pressure applied to the nozzles 21 when the position of the liquid level in the liquid accommodation unit 15 is the second position H2 is changed by a distance D4 between the position of the nozzle surface 21*a* and the second position H2 in the vertical direction Z.

In the embodiment, the controller 200 controls the third on/off valve 120 and the discharge flow pump 124.

Next, the control method for the liquid ejecting apparatus 11*a* by the controller 200 will be described.

The controller 200 causes the pressure in the liquid accommodation unit 15 to act on the nozzles 21 by opening the third on/off valve 120. Here, the pressure in the liquid accommodation unit 15 is adjusted to the second pressure which is lower than the first pressure and at which the gas-liquid interface formed at the nozzle 21 is maintained. Therefore, the controller 200 causes the pressure in the liquid accommodation unit 15 adjusted to the second pressure, which is lower than the first pressure and at which the gas-liquid interface formed at the nozzle 21 is maintained, to act on the nozzle 21, and causes the liquid in each liquid ejecting head 20 to be discharged toward the liquid discharge path 40.

Next, the circulation operation of the embodiment will be described.

The controller 200 drives the pressurization pump 81 and the discharge pump 88 to supply the liquid in the liquid accommodation unit 15 toward the liquid supply path 30. That is, the pressurization pump 81 and the discharge pump 88 cause the liquid stored in the liquid accommodation unit 15 to flow toward each supply-side pressure adjustment valve 31 via the liquid supply path 30. In the embodiment, the pressurization pump 81 and the discharge pump 88 are an example of the liquid flow mechanism.

Subsequently, when the liquid in each liquid ejecting head 20 is discharged toward the liquid discharge path 40, the controller 200 opens the third on/off valve 120 to cause the liquid accommodation unit 15 and each liquid ejecting head 20 to communicate with each other via the liquid discharge path 40. In doing so, the pressure in the liquid accommodation unit 15 acts on the nozzles 21 of each liquid ejecting head 20. Therefore, the liquid in each liquid ejecting head 20 can be discharged toward the liquid accommodation unit 15 having a lower pressure. That is, the controller 200 controls the third on/off valve 120 to cause the pressure in the liquid accommodation unit 15 to act on the nozzles 21 via the liquid discharge path 40, and discharges the liquid in each liquid ejecting head 20 toward the liquid discharge path 40.

In this case, the pressure in the liquid accommodation unit 15 is adjusted to the second pressure at which the gas-liquid interface formed at the nozzle 21 is maintained. Therefore, in the liquid ejecting apparatus 11*a*, it is possible to maintain the meniscus on the gas-liquid interface of the nozzles 21 when the liquid in the liquid ejecting apparatus 11*a* is circulated.

Then, the controller 200 closes the third on/off valve 120 to shut off the liquid accommodation unit 15 and each liquid ejecting head 20 from each other. In this way, the liquid ejecting apparatus 11*a* can circulate the liquid in the liquid ejecting apparatus 11*a*.

Next, actions of the liquid ejecting apparatus 11*a* of the embodiment will be described.

The holding unit 15*a* holds the liquid accommodation unit 15 at a predetermined position so that the pressure in the liquid accommodation unit 15 is adjusted to a pressure capable of maintaining the meniscus on the gas-liquid interface of the nozzle 21. The controller 200 opens the third on/off valve 120 to cause the pressure in the liquid accommodation unit 15 to act on the nozzle 21 when the circulation operation for circulating the liquid in the liquid ejecting apparatus 11*a* is performed. That is, the pressure applied to the nozzle 21 in the circulation operation is adjusted to a pressure capable of maintaining the meniscus on the gas-liquid interface of the nozzle 21.

Effects of the embodiment will be described.

(17) Since the liquid ejecting apparatus 11*a* includes the supply-side pressure adjustment valve 31 in the liquid supply path 30 through which the liquid is supplied to each liquid ejecting head 20, it is possible to adjust the pressure in the nozzle 21 by adjusting the pressure in the liquid accommodation unit 15 coupled to the liquid discharge path 40. Accordingly, the liquid ejecting apparatus 11*a* can suppress the pressure control at the time of performing the circulation operation for circulating the liquid being complicated.

(18) The liquid ejecting apparatus 11*a* can easily perform the circulation operation for discharging the liquid in each liquid ejecting head 20 toward the liquid discharge path 40 by opening or closing the third on/off valve 120.

(19) Since the liquid ejecting apparatus 11*a* includes the pressure damper 121 between the liquid ejecting head 20 and the third on/off valve 120 in the liquid discharge path 40, it is possible to reduce the pressure fluctuation, when the third on/off valve 120 is opened or closed, acting on the liquid ejecting head 20.

(20) The liquid ejecting apparatus 11*a* can adjust the pressure on the liquid supply path 30 to the first pressure by the supply-side pressure adjustment valve 31 and the liquid supply path 30 that are in the pressurized state, and can adjust the pressure on the liquid discharge path 40 to the second pressure by the position of the liquid accommodation unit 15.

(21) With the control method by the controller 200, it is possible to cause the pressure in the liquid accommodation unit 15 adjusted to the second pressure, which is lower than the first pressure and at which the gas-liquid interface formed at the nozzle 21 does not break, to act on the nozzle 21 via the liquid discharge path 40, and to discharge the liquid in each liquid ejecting head 20 toward the liquid discharge path 40. Therefore, it is possible to suppress the pressure control at the time of performing the circulation operation for circulating the liquid being complicated.

(22) With the control method by the controller 200, it is possible to cause the pressure in the liquid accommodation unit 15 adjusted to the second pressure, which is lower than the first pressure and at which the gas-liquid interface formed at the nozzle 21 does not break, to act on the nozzle 21 via the liquid discharge path 40 by opening the third on/off valve 120. Therefore, it is possible to suppress the pressure control at the time of performing the circulation operation for circulating the liquid being complicated.

Third Embodiment

Next, a third embodiment of a liquid ejecting apparatus will be described with reference to the drawings. The third embodiment is different from the first embodiment in that the discharge-side pressure adjustment valve 41 is not held by the head holder 90 and the bypass flow path 73 is not provided. Since in other points, the third embodiment is substantially the same as the first embodiment, the same reference numerals are given to the same configuration, and the duplicated description is omitted.

Figure 9:
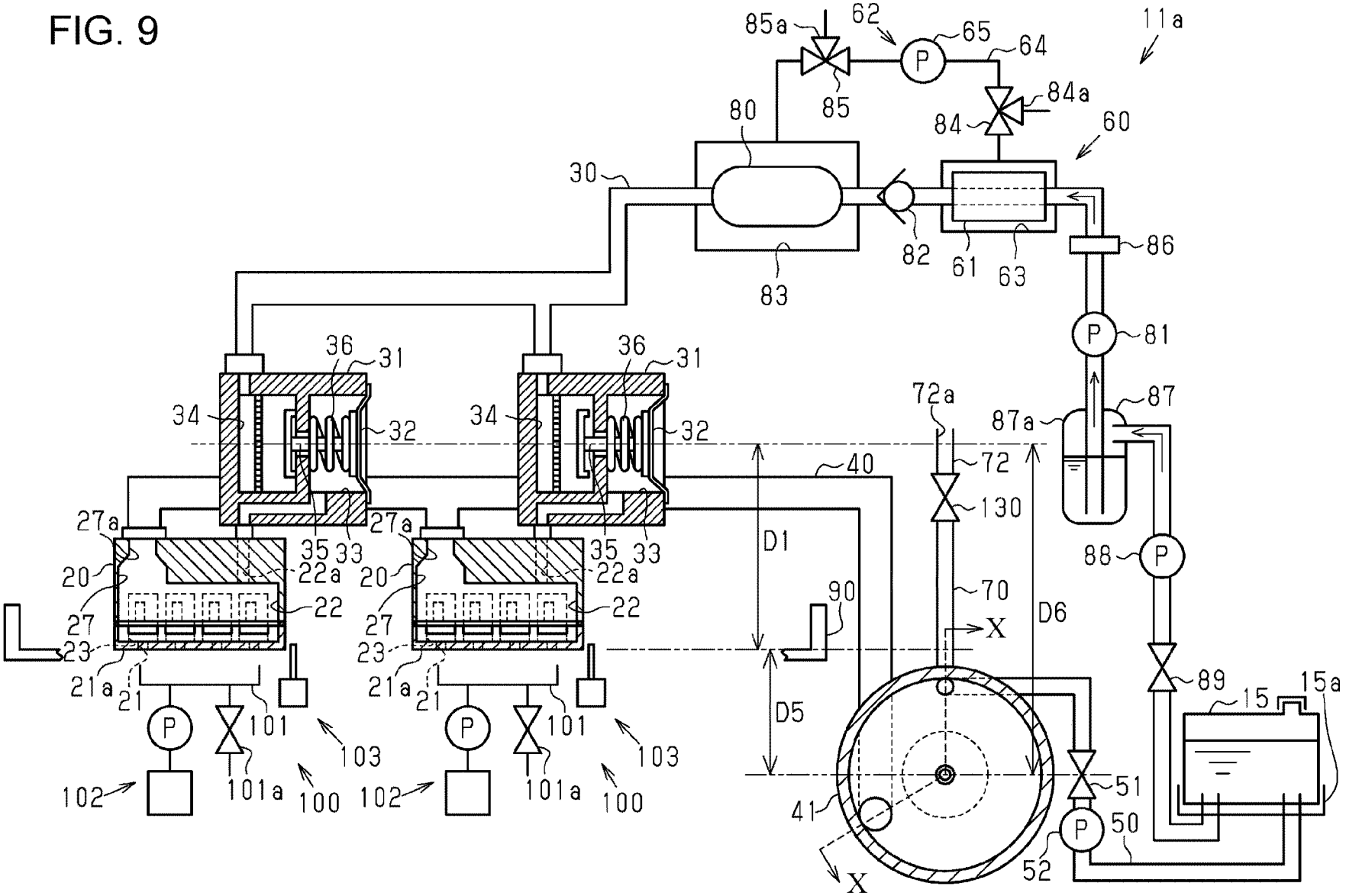
FIG. 9 is a schematic view illustrating a configuration of a liquid ejecting apparatus according to a third embodiment.
Figure 10:
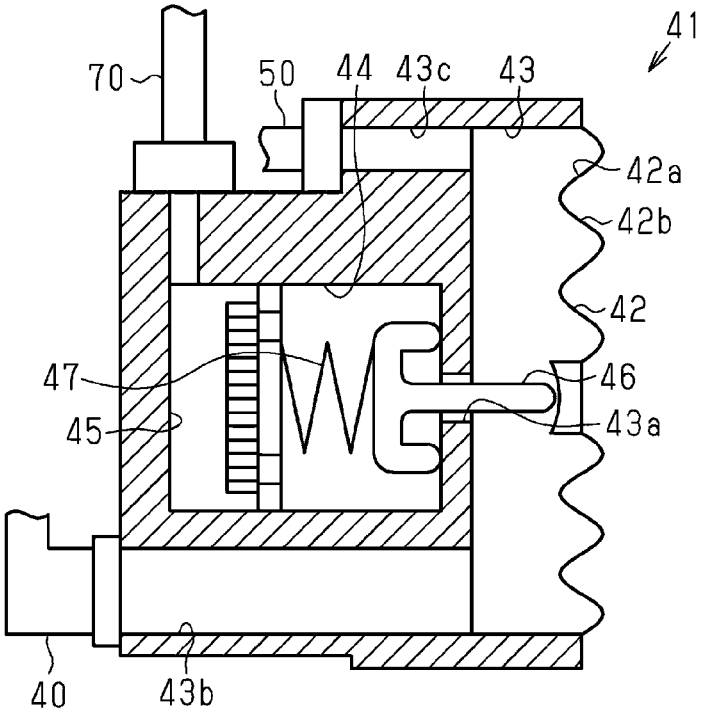
FIG. 10 is a sectional view taken along line X-X in FIG. 9.

As illustrated in FIGS. 9 and 10, the discharge-side pressure adjustment valve 41 is provided at a position where the central position of the pressure in the discharge-side liquid chamber 43 is lower than the nozzle surface 21*a* by a distance D5 in the vertical direction Z. Further, the discharge-side pressure adjustment valve 41 is provided at a position where the central position of the pressure in the discharge-side liquid chamber 43 is lower than the central position of the pressure in the supply-side liquid chamber 33 by a distance D6 in the vertical direction Z. The discharge-side pressure adjustment valve 41 is provided outside the head holder 90. That is, the discharge-side pressure adjustment valve 41 is configured such that the position of the discharge-side liquid chamber 43 in the vertical direction Z is not changed even when the head holder 90 is displaced along the vertical direction Z.

The fluid introduction path 70 is coupled to the atmospheric air communication path 72. Further, the liquid ejecting apparatus 11*a* includes a fourth on/off valve 130 which becomes a closed state to shut off the fluid introduction path 70 and the atmospheric air communication path 72 from each other. The fourth on/off valve 130 is provided at position higher than the nozzle surface 21*a* in the vertical direction Z. An opening end 72*a* which is open to the atmospheric air in the atmospheric air communication path 72 is provided at a position higher than the nozzle surface 21*a* in the vertical direction Z.

Next, actions of the liquid ejecting apparatus 11*a* of the embodiment will be described.

The position of the discharge-side liquid chamber 43 in the vertical direction Z is not changed even when the head holder 90 is displaced along the vertical direction Z. Therefore, the pressure in the discharge-side liquid chamber 43 is not changed even when the head holder 90 is displaced along the vertical direction Z.

The fourth on/off valve 130 and the opening end 72*a* of the atmospheric air communication path 72 are provided at a position higher than the nozzle surface 21*a* in the vertical direction Z. Therefore, when the fourth on/off valve 130 is in an open state, the gas-liquid interface in the flow path formed by the fluid introduction path 70 and the atmospheric air communication path 72 is formed at a position lower than the fourth on/off valve 130.

Effects of the embodiment will be described.

(23) Since the pressure in the discharge-side liquid chamber 43 is not changed even when the head holder 90 is displaced along the vertical direction Z, it is possible to accurately control the pressure in the discharge-side liquid chamber 43.

(24) When the fourth on/off valve 130 is in an open state, the gas-liquid interface in the flow path formed by the fluid introduction path 70 and the atmospheric air communication path 72 is formed at a position lower than the fourth on/off valve 130. Therefore, it is possible to suppress the liquid leaking from the opening end 72*a* of the atmospheric air communication path 72.

Fourth Embodiment

Next, a fourth embodiment of a liquid ejecting apparatus will be described with reference to the drawings. The fourth embodiment is different from the first embodiment in that a supply-side liquid storage unit 140 capable of storing liquid, and a supply-side storage unit pressure adjustment mechanism 141 that adjusts the pressure in the supply-side liquid storage unit 140 are provided as the supply-side pressure adjustment mechanism, instead of the supply-side pressure adjustment valve 31. Since in other points, the fourth embodiment is substantially the same as the first embodiment, the same reference numerals are given to the same configuration, and the duplicated description is omitted.

Figure 11:
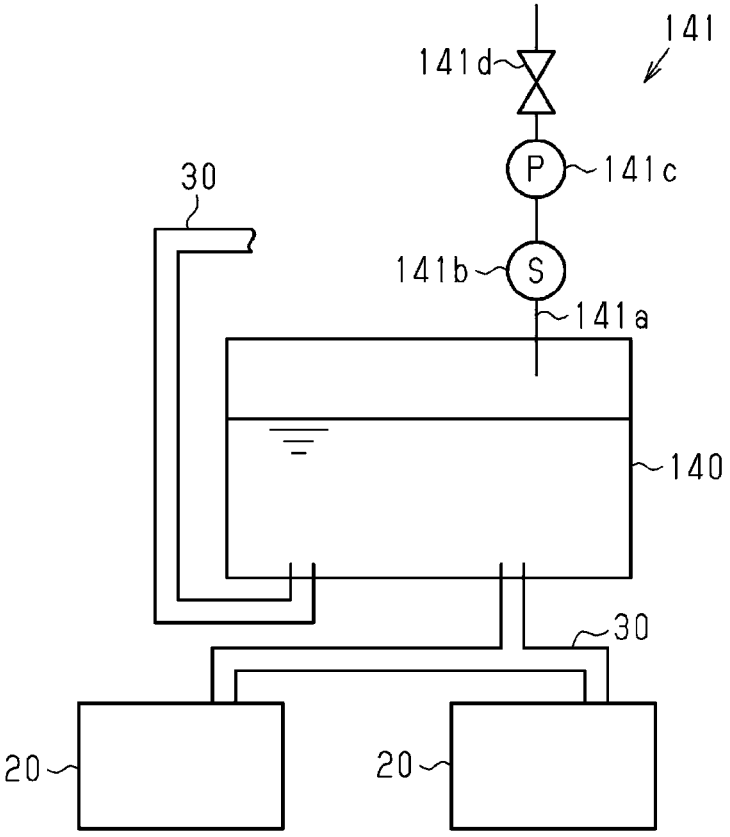
FIG. 11 is a schematic view illustrating a supply-side liquid storage unit according to a fourth embodiment.

As illustrated in FIG. 11, the supply-side liquid storage unit 140 is provided between the temporary storage unit 80 and the liquid ejecting head 20 in the liquid supply path 30. The supply-side liquid storage unit 140 communicates with the temporary storage unit 80 via the liquid supply path 30, and also communicates with each liquid ejecting head 20 via the liquid supply path 30.

The supply-side storage unit pressure adjustment mechanism 141 is capable of adjusting the pressure in the supply-side liquid storage unit 140 by adjusting the amount of gas in the supply-side liquid storage unit 140. In an example of the embodiment, the pressure in the supply-side liquid storage unit 140 is determined by the pressure of the gas at a predetermined position in the supply-side liquid storage unit 140. The pressure in the supply-side liquid storage unit 140 may be determined by the pressure applied to any position in the supply-side liquid storage unit 140. As an example, the pressure in the supply-side liquid storage unit 140 may be determined by the pressure applied to the liquid level of the liquid accommodated in the supply-side liquid storage unit 140, or may be determined by the pressure applied to the bottom surface of the supply-side liquid storage unit 140.

In an example of the embodiment, the supply-side storage unit pressure adjustment mechanism 141 includes an atmospheric air open path 141*a* having one end coupled to the supply-side liquid storage unit 140 and the other end open to the atmospheric air, a pressure gauge 141*b* that measures the pressure in the supply-side liquid storage unit 140, and a gas discharge pump 141*c* that is driven to discharge the gas in the supply-side liquid storage unit 140. The supply-side storage unit pressure adjustment mechanism 141 includes an atmospheric air open valve 141*d* which becomes in a closed state to close the atmospheric air open path 141*a*. The pressure gauge 141*b* is preferably a relative pressure gauge that measures a differential pressure from the atmospheric pressure.

When the pressure in the supply-side liquid storage unit 140 measured by the pressure gauge 141*b* is greater than the first pressure, the controller 200 opens the atmospheric air open valve 141*d* to drive the gas discharge pump 141*c* so that the gas in the supply-side liquid storage unit 140 is discharged and the supply-side liquid storage unit 140 is depressurized.

Next, actions of the liquid ejecting apparatus 11*a* of the embodiment will be described.

The supply-side liquid storage unit 140 communicates with the temporary storage unit 80 via the liquid supply path 30, and also communicates with each liquid ejecting head 20 via the liquid supply path 30 so that the liquid supplied from the temporary storage unit 80 is stored and the stored liquid is supplied to each liquid ejecting head 20. Further, by the communication between the supply-side liquid storage unit 140 and each liquid ejecting head 20, the pressure applied to the nozzles 21 of each liquid ejecting head 20 changes according to the pressure in the supply-side liquid storage unit 140.

Then, the controller 200 controls such that when the pressure in the supply-side liquid storage unit 140 is greater than the first pressure, the supply-side liquid storage unit 140 is depressurized to decrease the pressure of the gas acting on the liquid level of the liquid in the supply-side liquid storage unit 140, and thereby adjusts the pressure in the supply-side liquid storage unit 140 to the first pressure or lower.

Effects of the embodiment will be described.

(25) Since the pressure in the supply-side liquid storage unit 140 can be adjusted to the first pressure or lower by the control of the controller 200, the liquid ejecting apparatus 11*a* can accurately adjust the pressure applied to the nozzles 21.

Fifth Embodiment

Next, a fifth embodiment of a liquid ejecting apparatus and a control method for the liquid ejecting apparatus will be described with reference to the drawings. The fifth embodiment is different from the second embodiment in that an auxiliary liquid accommodation unit 150 is provided as the liquid storage unit in the liquid discharge path 40 and can accommodate the liquid. Since in other points, the fifth embodiment is substantially the same as the second embodiment, the same reference numerals are given to the same configuration, and the duplicated description is omitted.

Figure 12:
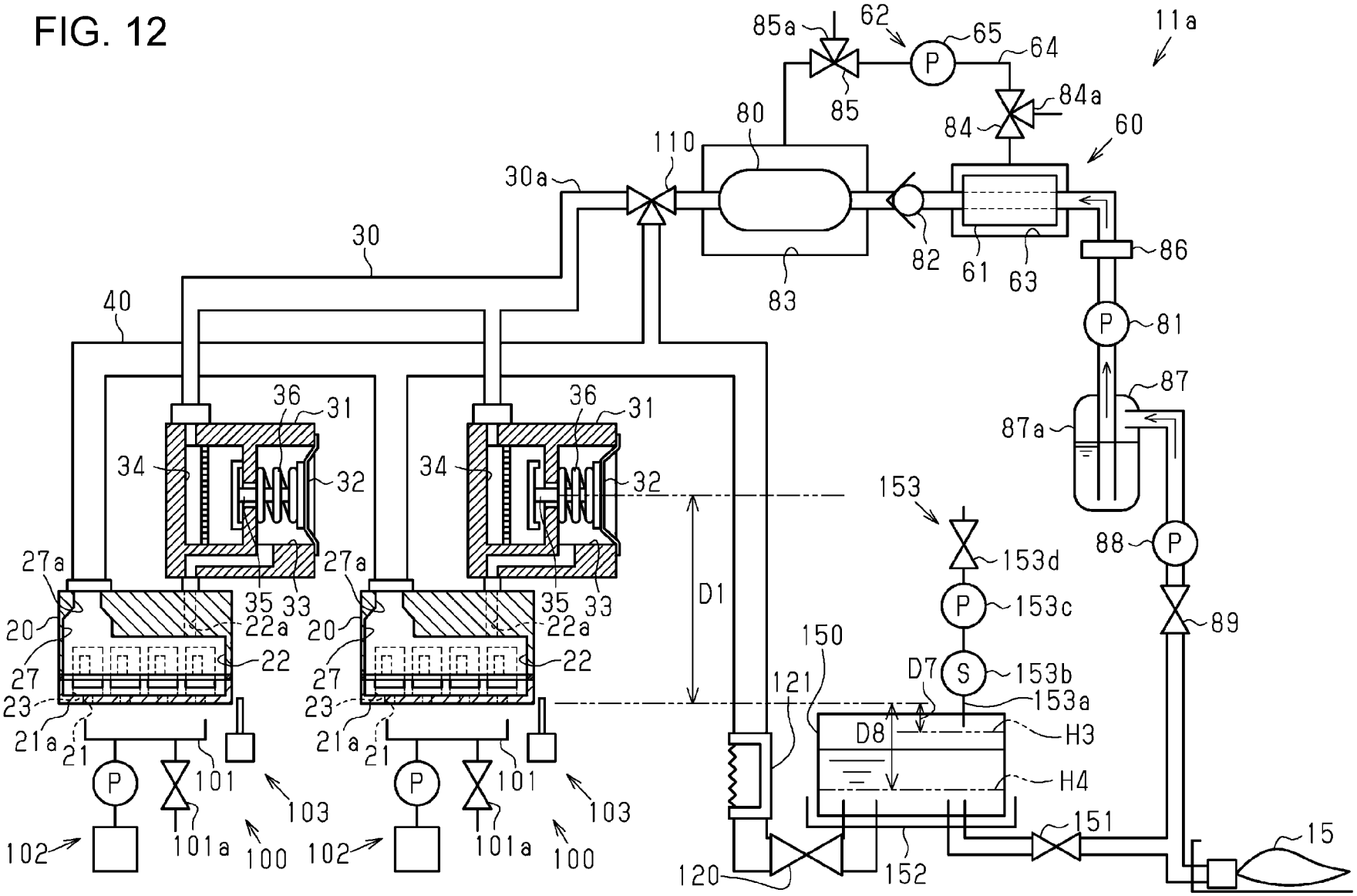
FIG. 12 is a schematic view illustrating a configuration of a liquid ejecting apparatus according to a fifth embodiment.

As illustrated in FIG. 12, the auxiliary liquid accommodation unit 150 is provided between the third on/off valve 120 and the liquid accommodation unit 15 in the liquid discharge path 40. The auxiliary liquid accommodation unit 150 communicates with each liquid ejecting head 20 via the liquid discharge path 40, and also communicates with the liquid accommodation unit 15 via the liquid discharge path 40. Further, the liquid ejecting apparatus 11*a* includes a fifth on/off valve 151 between the auxiliary liquid accommodation unit 150 and the liquid accommodation unit 15 in the liquid discharge path 40. The fifth on/off valve 151 becomes a closed state to close the liquid discharge path 40. Further, the liquid ejecting apparatus 11*a* includes an auxiliary holding unit 152 that holds the auxiliary liquid accommodation unit 150 as an example of the storage unit pressure adjustment mechanism.

The auxiliary liquid accommodation unit 150 is held by the auxiliary holding unit 152 such that the position of the liquid level in the auxiliary liquid accommodation unit 150 in the vertical direction Z is within a range from a third position H3 to a fourth position H4. The third position H3 is a position of the liquid level when the maximum amount of the liquid that can be accommodated in the auxiliary liquid accommodation unit 150 is accommodated. The fourth position H4 is a position of the liquid level when the minimum amount of the liquid that can be supplied from the auxiliary liquid accommodation unit 150 to each liquid ejecting head 20 and the liquid accommodation unit 15 is accommodated.

In an example of the embodiment, the position of the liquid level in the auxiliary liquid accommodation unit 150 in a range from the third portion H3 to the fourth position H4 is a position of the liquid level in the auxiliary liquid accommodation unit 150 when the pressure as the potential energy of the liquid in the auxiliary liquid accommodation unit 150 in a case where the auxiliary liquid accommodation unit 150 is opened to the atmospheric air becomes a pressure which is lower than the first pressure and at which the gas-liquid interface formed at the nozzle 21 is maintained. That is, in an example of the embodiment, the pressure in the auxiliary liquid accommodation unit 150 is adjusted to the second pressure which is lower than the first pressure and at which the gas-liquid interface formed at the nozzle 21 is maintained, by the auxiliary liquid accommodation unit 150 being held by the auxiliary holding unit 152. That is, the auxiliary holding unit 152 holds the auxiliary liquid accommodation unit 150 at a position at which the pressure in the auxiliary liquid accommodation unit 150 acting on the nozzle 21 via the liquid discharge path 40 becomes the second pressure. In an example of the embodiment, the pressure in the auxiliary liquid accommodation unit 150 is determined by the pressure of the gas at a predetermined position in the auxiliary liquid accommodation unit 150. The pressure in the auxiliary liquid accommodation unit 150 may be determined by the pressure applied to any position in the auxiliary liquid accommodation unit 150. As an example, the pressure in the auxiliary liquid accommodation unit 150 may be determined by the pressure applied to the liquid level of the liquid accommodated in the auxiliary liquid accommodation unit 150, or may be determined by the pressure applied to the bottom surface of the auxiliary liquid accommodation unit 150.

In this case, the difference between the pressure applied to the nozzles 21 and the pressure in the auxiliary liquid accommodation unit 150 is changed by the distance between the position of the nozzle surface 21*a* and the position of the liquid level in the auxiliary liquid accommodation unit 150 in the vertical direction Z. Therefore, the pressure applied to the nozzles 21 when the position of the liquid level in the auxiliary liquid accommodation unit 150 is the third position H3 is changed by a distance D7 between the position of the nozzle surface 21*a* and the third position H3 in the vertical direction Z. Further, the pressure applied to the nozzles 21 when the position of the liquid level in the auxiliary liquid accommodation unit 150 is the fourth position H4 is changed by a distance D8 between the position of the nozzle surface 21*a* and the fourth position H4 in the vertical direction Z.

Further, the liquid ejecting apparatus 11*a* includes a gas amount adjustment mechanism 153 that adjusts the pressure in the auxiliary liquid accommodation unit 150 by adjusting the amount of the gas in the auxiliary liquid accommodation unit 150 as an example of the storage unit pressure adjustment mechanism.

The gas amount adjustment mechanism 153 includes an auxiliary atmospheric air open path 153*a* having one end coupled to the auxiliary liquid accommodation unit 150 and the other end open to the atmospheric air, an auxiliary pressure gauge 153*b* that measures the pressure in the auxiliary liquid accommodation unit 150, and a gas amount adjustment pump 153*c* that is driven to adjust the amount of the gas in the auxiliary liquid accommodation unit 150. The gas amount adjustment mechanism 153 includes an auxiliary atmospheric air open valve 153*d* which becomes in a closed state to close the auxiliary atmospheric air open path 153*a*. The auxiliary pressure gauge 153*b* is preferably a relative pressure gauge that measures a differential pressure from the atmospheric pressure.

When the pressure in the auxiliary liquid accommodation unit 150 measured by the auxiliary pressure gauge 153*b* is not the second pressure, the controller 200 opens the auxiliary atmospheric air open valve 153*d* and drives the gas amount adjustment pump 153*c* to adjust the amount of the gas in the auxiliary liquid accommodation unit 150 so that the pressure in the auxiliary liquid accommodation unit 150 becomes the second pressure.

Next, actions of the liquid ejecting apparatus 11*a* of the embodiment will be described.

The pressure in the auxiliary liquid accommodation unit 150 is adjusted to the second pressure capable of maintaining the meniscus on the gas-liquid interface of the nozzle 21 by the auxiliary liquid accommodation unit 150 being held at a predetermined position by the auxiliary holding unit 152. In other words, the auxiliary holding unit 152 holds the auxiliary liquid accommodation unit 150 at a predetermined position so that the pressure in the auxiliary liquid accommodation unit 150 is adjusted to the second pressure capable of maintaining the meniscus on the gas-liquid interface of the nozzle 21. The controller 200 opens the third on/off valve 120 to cause the pressure in the auxiliary liquid accommodation unit 150 to act on the nozzle 21 when the circulation operation for circulating the liquid in the liquid ejecting apparatus 11*a* is performed. That is, the pressure applied to the nozzle 21 in the circulation operation is adjusted to a pressure capable of maintaining the meniscus on the gas-liquid interface of the nozzle 21.

When the pressure in the auxiliary liquid accommodation unit 150 is not the second pressure, the controller 200 controls the gas amount adjustment mechanism 153 and adjusts the pressure in the auxiliary liquid accommodation unit 150 to the second pressure.

Next, the control method for the liquid ejecting apparatus 11*a* by the controller 200 will be described.

When the liquid in each liquid ejecting head 20 is discharged toward the liquid discharge path 40, the controller 200 executes a step of measuring the pressure in the auxiliary liquid accommodation unit 150 by the auxiliary pressure gauge 153*b*. Subsequently, the controller 200 executes a step of opening the auxiliary atmospheric air open valve 153*d* according to the measured pressure, driving the gas amount adjustment pump 153*c*, and adjusting the pressure in the auxiliary liquid accommodation unit 150 to the second pressure which is lower than the first pressure and at which the gas-liquid interface formed at the nozzle 21 is maintained. Thereafter, the controller 200 executes a step of opening the third on/off valve 120. With such a control method, the controller 200 causes the pressure in the auxiliary liquid accommodation unit 150 to act on the nozzles 21 in the circulation operation. That is, the controller 200 causes the pressure in the auxiliary liquid accommodation unit 150 adjusted to the second pressure, which is lower than the first pressure and at which the gas-liquid interface formed at the nozzle 21 is maintained, to act on the nozzle 21, and discharges the liquid in each liquid ejecting head 20 toward the liquid discharge path 40.

In the circulation operation, when the auxiliary atmospheric air open valve 153*d* is opened to cause the auxiliary liquid accommodation unit 150 to be open to the atmospheric air, and the pressure in the auxiliary liquid accommodation unit 150 adjusted in a range from the third position H3 to the fourth position H4 acts on the nozzle 21 so that the liquid in each liquid ejecting head 20 is discharged toward the liquid discharge path 40, the controller 200 may control the storage unit pressure adjustment mechanism and each on/off valve as follows.

For example, when the position of the liquid level of the liquid in the auxiliary liquid accommodation unit 150 is higher than the third position H3 in the vertical direction Z, the controller 200 opens the auxiliary atmospheric air open valve 153*d* and drives the gas amount adjustment pump 153*c* in a state where the third on/off valve 120 is closed and the fifth on/off valve 151 is opened, to pressurize the auxiliary liquid accommodation unit 150, discharges the liquid in the auxiliary liquid accommodation unit 150 toward the liquid accommodation unit 15 to adjust the position of the liquid level of the liquid in the auxiliary liquid accommodation unit 150 to the third position H3, stops the driving of the gas amount adjustment pump 153*c*, and closes the fifth on/off valve 151.

Further, for example, when the position of the liquid level of the liquid in the auxiliary liquid accommodation unit 150 is lower than the fourth position H4 in the vertical direction Z, the controller 200 opens the auxiliary atmospheric air open valve 153*d* and drives the gas amount adjustment pump 153*c* in a state where the third on/off valve 120 is closed and the fifth on/off valve 151 is opened, to depressurize the auxiliary liquid accommodation unit 150, cause the liquid to flow into the auxiliary liquid accommodation unit 150 from the liquid accommodation unit 15 to adjust the position of the liquid level of the liquid in the auxiliary liquid accommodation unit 150 to the fourth position H4, stops the driving of the gas amount adjustment pump 153*c*, and closes the fifth on/off valve 151. When the circulation operation for discharging the liquid in each liquid ejecting head 20 toward the liquid discharge path 40 is performed, the controller 200 opens the auxiliary atmospheric air open valve 153*d* and closes the third on/off valve 120.

Effects of the embodiment will be described.

(26) The liquid ejecting apparatus 11*a* can adjust the pressure in the nozzle 21 by adjusting the pressure in the auxiliary liquid accommodation unit 150 coupled to the liquid discharge path 40. Accordingly, the liquid ejecting apparatus 11*a* can suppress the pressure control at the time of performing the circulation operation for circulating the liquid being complicated.

(27) Since the pressure in the auxiliary liquid accommodation unit 150 can be adjusted to the second pressure by the control of the controller 200, the liquid ejecting apparatus 11*a* can accurately adjust the pressure applied to the nozzles 21.

(28) With the control method by the controller 200, it is possible to cause the pressure in the auxiliary liquid accommodation unit 150 adjusted to the second pressure, which is lower than the first pressure and at which the gas-liquid interface formed at the nozzle 21 does not break, to act on the nozzle 21 via the liquid discharge path 40, and to discharge the liquid in each liquid ejecting head 20 toward the liquid discharge path 40. Therefore, it is possible to suppress the pressure control at the time of performing the circulation operation for circulating the liquid being complicated.

(29) With the control method by the controller 200, it is possible to cause the pressure in the auxiliary liquid accommodation unit 150 adjusted to the second pressure, which is lower than the first pressure and at which the gas-liquid interface formed at the nozzle 21 does not break, to act on the nozzle 21 via the liquid discharge path 40 by opening the third on/off valve 120. Therefore, it is possible to suppress the pressure control at the time of performing the circulation operation for circulating the liquid being complicated.

The embodiments can be implemented with following modifications. The embodiments and the following modification examples can be implemented in combination with each other in the technically consistent range.

In a state where the liquid in the liquid ejecting apparatus 11*a* is circulated, the liquid ejecting unit 12 may perform recording by ejecting the liquid to the paper sheet 14 as a recording medium.

In the second embodiment, when the flow path from the supply-side liquid chamber 33 of each supply-side pressure adjustment valve 31 to the nozzles 21 of each liquid ejecting head 20 is the first flow path and the flow path from the nozzle 21 to the liquid accommodation unit 15 is the second flow path, the flow path resistance of the second flow path may be smaller than the flow path resistance of the first flow path, similar to the first embodiment.

In the fifth embodiment, when the flow path from the supply-side liquid chamber 33 of each supply-side pressure adjustment valve 31 to the nozzles 21 of each liquid ejecting head 20 is the first flow path and the flow path from the nozzle 21 to the auxiliary liquid accommodation unit 150 is the second flow path, the flow path resistance of the second flow path may be smaller than the flow path resistance of the first flow path, similar to the first embodiment.

As illustrated in FIGS. 2, 9, and 10, in the first, third, and fourth embodiments, the posture of the discharge-side pressure adjustment valve 41 can be appropriately changed. As illustrated in FIG. 2, the discharge-side pressure adjustment valve 41 may be provided in a posture in which the discharge-side flexible portion 42 becomes the bottom surface of the discharge-side liquid chamber 43. As illustrated in FIGS. 9 and 10, the discharge-side pressure adjustment valve 41 may be provided in a posture in which the discharge-side flexible portion 42 becomes the side wall of the discharge-side liquid chamber 43. That is, the discharge-side pressure adjustment valve 41 may be provided in a posture in which in the discharge-side liquid chamber 43, the second communication hole 43*b* communicating with the liquid discharge path 40 is provided at a position lower than the first communication hole 43*a* communicating with the first discharge-side communication chamber 44 in the vertical direction Z and the third communication hole 43*c* communicating with the return flow path 50 is provided at a position higher than the first communication hole 43*a* in the vertical direction Z.

In the third embodiment, the fluid introduction path 70 may be coupled to the atmospheric air communication path 72 and the bypass flow path 73 via the first switch valve 71. In this case, it is preferable that the first switch valve 71 and the opening end 72*a* of the atmospheric air communication path 72 are provided at a position higher than the nozzle surface 21*a* in the vertical direction Z. Further, the fluid introduction path 70 may be coupled to the bypass flow path 73 and may not be coupled to the atmospheric air communication path 72.

In the fifth embodiment, the controller 200 may cause the pressure in the auxiliary liquid accommodation unit 150 to act on the nozzles 21 and thereby discharges the liquid in each liquid ejecting head 20 toward the liquid discharge path 40 while performing control to open the auxiliary atmospheric air open valve 153*d* and drive the gas amount adjustment pump 153*c* such that the pressure in the auxiliary liquid accommodation unit 150 measured by the auxiliary pressure gauge 153*b* becomes the second pressure. In this case, the position of the liquid level in the auxiliary liquid accommodation unit 150 in the vertical direction Z may not be adjusted to a range from the third position H3 to the fourth position H4.

In the fifth embodiment, the pressure in the auxiliary liquid accommodation unit 150 may be adjusted to the second pressure by provided any one of the auxiliary holding unit 152 holding the auxiliary liquid accommodation unit 150 and the gas amount adjustment mechanism 153 adjusting the pressure in the auxiliary liquid accommodation unit 150.

In the fifth embodiment, when the gas amount adjustment mechanism 153 adjusting the pressure in the auxiliary liquid accommodation unit 150 is not provided, the auxiliary liquid accommodation unit 150 may be caused to be in a state where the inside of the auxiliary liquid accommodation unit 150 is open to the atmospheric air, similar to the liquid accommodation unit 15 illustrated in FIG. 8, a liquid level detection sensor that detects the liquid level of the liquid in the auxiliary liquid accommodation unit 150 may be provided, and the position of the liquid level in the auxiliary liquid accommodation unit 150 in the vertical direction Z may be adjusted to be in a range from the third position H3 to the fourth position H4. For example, when the liquid flows into the auxiliary liquid accommodation unit 150 via the liquid discharge path 40 by the circulation operation and it is detected that the position of the liquid level becomes the third position H3, the controller 200 may drive the discharge pump until the position of the liquid level becomes the fourth position H4 in a state where the third on/off valve 120 is closed and the fifth on/off valve 151 and the second on/off valve 89 are opened. Further, for example, when the liquid flows into the auxiliary liquid accommodation unit 150 via the liquid discharge path 40 by the circulation operation and it is detected that the position of the liquid level becomes the third position H3, the controller 200 causes the liquid in the auxiliary liquid accommodation unit 150 to flow into the liquid accommodation unit 15 by using the fact that the liquid accommodation unit 15 is provided at a position lower than the auxiliary liquid accommodation unit 150 in the vertical direction Z, in a state where the third on/off valve 120 is closed and the fifth on/off valve 151 is opened, and closes the fifth on/off valve 151 when it is detected that the position of the liquid level becomes the fourth position H4.

The degassing of the liquid is not limited to the depressurization via the hollow fiber membrane 61, and any method such as ultrasonic degassing or centrifugal degassing can be adopted.

In the pressurization cleaning process, the cap opening valve 101*a* may be opened instead of releasing the capping in step S21. In this configuration, since the pressurization cleaning can be executed while the capping is being performed, it is possible to suppress the scattering of the liquid flowing out from the nozzles 21.

The recording medium is not limited to the paper sheet 14, and may be a fabric, a plastic film, or a metal film.

The controller 200 may be implemented by software using a CPU executing a program, may be implemented by hardware using an electronic circuit (for example, semiconductor integrated circuit) such as a field programmable gate array (FPGA) or an application specific integrated circuit (ASIC), or may be implemented by the cooperation of software and hardware.

The liquid discharged by each liquid ejecting head 20 is not limited to ink, and may be, for example, a liquid material in which particles of a functional material are dispersed or mixed. For example, each liquid ejecting head 20 may discharge a liquid material in which a material such as an electrode material or a pixel material used for manufacturing a liquid crystal display, an electroluminescence display, and a surface emitting display is dispersed or dissolved.

Hereinafter, the technical ideas ascertained from the above-described embodiments and modification examples, and effects thereof are described.

A liquid ejecting apparatus includes: a liquid ejecting head that has a nozzle surface in which a nozzle that ejects liquid is open; a liquid supply path which is coupled to a liquid inlet of the liquid ejecting head and through which the liquid is supplied to the liquid ejecting head; a liquid discharge path which is coupled to a liquid outlet of the liquid ejecting head and through which the liquid is discharged from the liquid ejecting head; a supply-side pressure adjustment mechanism that adjusts a pressure in a supply-side liquid chamber provided in the liquid supply path to a first pressure at which a gas-liquid interface formed at the nozzle is maintained; a discharge-side pressure adjustment valve that is provided in the liquid discharge path, includes a discharge-side liquid chamber coupled to the liquid outlet and a discharge-side valve body, and adjusts a pressure of the liquid to be supplied to the liquid ejecting head to a pressure at which the gas-liquid interface formed at the nozzle is maintained, the discharge-side valve body being configured to be opened when a pressure in the discharge-side liquid chamber becomes a second pressure which is lower than the first pressure and a pressure outside the discharge-side liquid chamber and at which the gas-liquid interface formed at the nozzle is maintained, to cause the discharge-side liquid chamber to communicate with a fluid introduction path through which fluid is introduced into the discharge-side liquid chamber from an outside of the discharge-side liquid chamber; and a flow mechanism that is coupled to the discharge-side liquid chamber by a return flow path and is configured to discharge the liquid in the liquid ejecting head toward the liquid discharge path via the discharge-side liquid chamber of the discharge-side pressure adjustment valve.

With this configuration, the liquid ejecting apparatus includes the discharge-side pressure adjustment valve in the liquid discharge path through which the liquid is discharged from the liquid ejecting head. Therefore, the liquid ejecting apparatus can reduce the pressure fluctuation in the nozzle when the liquid is discharged from the liquid outlet by driving the flow mechanism in the circulation operation for circulating the liquid. Accordingly, the liquid ejecting apparatus can suppress the pressure control at the time of performing the circulation operation being complicated.

In the liquid ejecting apparatus, the supply-side pressure adjustment mechanism may be a supply-side pressure adjustment valve that includes the supply-side liquid chamber and a supply-side valve body that is opened when the pressure in the supply-side liquid chamber becomes the first pressure lower than a pressure outside the supply-side liquid chamber, to cause the supply-side liquid chamber to communicate with the liquid supply path that is upstream of the supply-side liquid chamber, and adjusts the pressure of the liquid to be supplied to the liquid ejecting head to a pressure at which the gas-liquid interface formed at the nozzle is maintained.

With this configuration, the liquid ejecting apparatus can adjust the pressure in the supply-side liquid chamber by the supply-side pressure adjustment valve. Therefore, the liquid ejecting apparatus can easily control the pressure in the supply-side liquid chamber as compared with a case of adjusting the pressure in the supply-side liquid chamber by using the pump and the sensor, for example.

In the liquid ejecting apparatus, the supply-side pressure adjustment valve may include a supply-side flexible portion that forms a wall portion of the supply-side liquid chamber and is bent when the pressure in the supply-side liquid chamber changes, and a supply-side bias member that biases the supply-side valve body in a direction of closing the supply-side valve body.

With this configuration, since the pressure fluctuation in the supply-side liquid chamber can be reduced by bending the supply-side flexible portion, the liquid ejecting apparatus can easily control the pressure in the supply-side liquid chamber.

In the liquid ejecting apparatus, the discharge-side pressure adjustment valve may include a discharge-side flexible portion that forms a wall portion of the discharge-side liquid chamber and is bent when the pressure in the discharge-side liquid chamber changes, and a discharge-side bias member that biases the discharge-side valve body in a direction of closing the discharge-side valve body.

With this configuration, since the pressure fluctuation in the discharge-side liquid chamber can be reduced by bending the discharge-side flexible portion, the liquid ejecting apparatus can easily control the pressure in the discharge-side liquid chamber.

In the liquid ejecting apparatus, the liquid discharge path that couples the liquid outlet and the discharge-side liquid chamber of the discharge-side pressure adjustment valve may be open to the discharge-side liquid chamber at a position lower than a position where the fluid flowing from the fluid introduction path flows into the discharge-side liquid chamber.

With this configuration, the liquid ejecting apparatus can suppress the fluid, which has flowed into the discharge-side liquid chamber from the fluid introduction path, flowing toward the liquid discharge path.

In the liquid ejecting apparatus, the return flow path that couples the discharge-side liquid chamber of the discharge-side pressure adjustment valve and the flow mechanism may be open to the discharge-side liquid chamber at a position higher than a position where the fluid flowing from the fluid introduction path flows into the discharge-side liquid chamber.

With this configuration, the liquid ejecting apparatus can efficiently discharge the fluid, which has flowed into the discharge-side liquid chamber from the fluid introduction path, from the discharge-side liquid chamber via the return flow path.

In the liquid ejecting apparatus, the fluid introduction path may couple the discharge-side liquid chamber of the discharge-side pressure adjustment valve and an upstream liquid supply path that is upstream of the supply-side liquid chamber in the liquid supply path.

With this configuration, the liquid ejecting apparatus can maintain the pressure in the discharge-side liquid chamber by introducing the liquid, which is the same as the liquid to be supplied to the liquid ejecting head, into the discharge-side liquid chamber when the discharge-side liquid chamber becomes the second pressure.

In the liquid ejecting apparatus, the fluid introduction path may be configured to introduce gas into the discharge-side liquid chamber of the discharge-side pressure adjustment valve.

With this configuration, the liquid ejecting apparatus can discharge the liquid via the return flow path by driving the flow mechanism such that the pressure in the discharge-side liquid chamber becomes lower than the second pressure when the liquid in the discharge-side pressure adjustment valve and the return flow path is discharged.

What is claimed is:

1. A liquid ejecting apparatus comprising:

a liquid ejecting head that has a nozzle surface in which a nozzle that ejects liquid is open;

a liquid supply path which is coupled to a liquid inlet of the liquid ejecting head and through which the liquid is supplied to the liquid ejecting head;

a liquid discharge path which is coupled to a liquid outlet of the liquid ejecting head and through which the liquid is discharged from the liquid ejecting head;

a supply-side pressure adjustment mechanism that adjusts a pressure in a supply-side liquid chamber provided in the liquid supply path to a first pressure at which a gas-liquid interface formed at the nozzle is maintained;

a discharge-side pressure adjustment valve that is provided in the liquid discharge path, includes a discharge-side liquid chamber coupled to the liquid outlet and a discharge-side valve body, and adjusts a pressure of the liquid to be supplied to the liquid ejecting head to a pressure at which the gas-liquid interface formed at the nozzle is maintained, the discharge-side valve body being configured to be opened when a pressure in the discharge-side liquid chamber becomes a second pressure which is lower than the first pressure and a pressure outside the discharge-side liquid chamber and at which the gas-liquid interface formed at the nozzle is maintained, to cause the discharge-side liquid chamber to communicate with a fluid introduction path through which fluid is introduced into the discharge-side liquid chamber from an outside of the discharge-side liquid chamber; and a flow mechanism that is coupled to the discharge-side liquid chamber by a return flow path and is configured to discharge the liquid in the liquid ejecting head toward the liquid discharge path via the discharge-side liquid chamber of the discharge-side pressure adjustment valve.

2. The liquid ejecting apparatus according to claim 1, wherein the supply-side pressure adjustment mechanism is a supply-side pressure adjustment valve including the supply-side liquid chamber and a supply-side valve body that is opened when the pressure in the supply-side liquid chamber becomes the first pressure lower than a pressure outside the supply-side liquid chamber to cause the supply-side liquid chamber to communicate with the liquid supply path that is upstream of the supply-side liquid chamber and adjusting the pressure of the liquid to be supplied to the liquid ejecting head to a pressure at which the gas-liquid interface formed at the nozzle is maintained.

3. The liquid ejecting apparatus according to claim 2, wherein the supply-side pressure adjustment valve includes a supply-side flexible portion that forms a wall portion of the supply-side liquid chamber and is bent when the pressure in the supply-side liquid chamber changes and a supply-side bias member that biases the supply-side valve body in a direction of closing the supply-side valve body.

4. The liquid ejecting apparatus according to claim 1, wherein the discharge-side pressure adjustment valve includes a discharge-side flexible portion that forms a wall portion of the discharge-side liquid chamber and is bent when the pressure in the discharge-side liquid chamber changes and a discharge-side bias member that biases the discharge-side valve body in a direction of closing the discharge-side valve body.

5. The liquid ejecting apparatus according to claim 1, wherein the liquid discharge path that couples the liquid outlet and the discharge-side liquid chamber of the discharge-side pressure adjustment valve is open to the discharge-side liquid chamber at a position lower than a position where the fluid flowing from the fluid introduction path flows into the discharge-side liquid chamber.

6. The liquid ejecting apparatus according to claim 1, wherein the return flow path that couples the discharge-side liquid chamber of the discharge-side pressure adjustment valve and the flow mechanism is open to the discharge-side liquid chamber at a position higher than a position where the fluid flowing from the fluid introduction path flows into the discharge-side liquid chamber.

7. The liquid ejecting apparatus according to claim 1, wherein the fluid introduction path couples the discharge-side liquid chamber of the discharge-side pressure adjustment valve and an upstream liquid supply path that is upstream of the supply-side liquid chamber in the liquid supply path.

8. The liquid ejecting apparatus according to claim 1, wherein the fluid introduction path is configured to introduce gas into the discharge-side liquid chamber of the discharge-side pressure adjustment valve.

* * * * *